US012654891B2

(12) United States Patent
Ishiguro et al.

(10) Patent No.: US 12,654,891 B2
(45) Date of Patent: Jun. 16, 2026

(54) BINDING MACHINE

(71) Applicant: Max Co., Ltd., Tokyo (JP)

(72) Inventors: Hiroki Ishiguro, Tokyo (JP); Taichi Yamazaki, Tokyo (JP); Shigeki Shindou, Tokyo (JP); Yusuke Yoshida, Tokyo (JP); Tetsuro Fukuda, Tokyo (JP); Shingo Takahashi, Tokyo (JP); Makoto Kosuge, Tokyo (JP)

(73) Assignee: Max Co., Ltd., Tokyo (JP)

( * ) Notice: Subject to any disclaimer, the term of this patent is extended or adjusted under 35 U.S.C. 154(b) by 263 days.

(21) Appl. No.: 18/397,834

(22) Filed: Dec. 27, 2023

(65) Prior Publication Data

US 2024/0208683 A1 Jun. 27, 2024

(30) Foreign Application Priority Data

Dec. 27, 2022 (JP) ..... 2022-209413
Oct. 31, 2023 (JP) ..... 2023-186612

(51) Int. Cl.
*B65B 13/04* (2006.01)
*B21F 15/04* (2006.01)
(Continued)

(52) U.S. Cl.
CPC ..... *B65B 13/025* (2013.01); *B21F 15/04* (2013.01); *B65B 13/04* (2013.01); *B65B 13/285* (2013.01); *E04G 21/123* (2013.01)

(58) Field of Classification Search
CPC .. B21F 7/00; B21F 15/04; B21F 15/06; E04G 21/122; E04G 21/123; B65B 13/02;
(Continued)

(56) References Cited

U.S. PATENT DOCUMENTS

2018/0207709 A1 7/2018 Kasahara et al.
2020/0399914 A1* 12/2020 Nagaoka ..... B21F 15/04
(Continued)

FOREIGN PATENT DOCUMENTS

EP 3327224 A1 5/2018
EP 3696344 A1 8/2020
(Continued)

OTHER PUBLICATIONS

May 24, 2024—(EP) Search Report—App 23219685.7.

*Primary Examiner* — Jared O Brown
(74) *Attorney, Agent, or Firm* — Banner & Witcoff, Ltd.

(57) ABSTRACT

A binding machine includes a magazine configured to accommodate a wire, a wire feeding portion configured to feed the wire accommodated in the magazine, a curl forming portion configured to constitute an annular feeding path for winding the wire fed by the wire feeding portion around a binding object, and a binding portion configured to twist the wire wound around the binding object. The curl forming portion includes a curling guide that curls the wire fed by the wire feeding portion, and a leading guide that leads the wire curled by the curling guide to the binding portion. The magazine includes a feeding path forming portion that forms a feeding path of the wire, and a regulating portion that regulates movement of the wire in a direction intersecting a direction in which the wire is fed in the feeding path forming portion.

20 Claims, 32 Drawing Sheets

(51) Int. Cl.
*B65B 13/02* (2006.01)
*B65B 13/28* (2006.01)
*E04G 21/12* (2006.01)

(58) Field of Classification Search
CPC ..... B65B 13/025; B65B 13/04; B65B 13/28; B65B 13/285
See application file for complete search history.

(56) References Cited

U.S. PATENT DOCUMENTS

| | | | | |
|---|---|---|---|---|
| 2021/0387246 | A1 | 12/2021 | Kasahara et al. | |
| 2022/0298813 | A1* | 9/2022 | Mizuno ..... | B21F 15/04 |

FOREIGN PATENT DOCUMENTS

| | | | |
|---|---|---|---|
| EP | 4170108 | A1 | 4/2023 |
| JP | 6566310 | B2 | 8/2019 |

* cited by examiner

BINDING MACHINE

CROSS-REFERENCE TO RELATED APPLICATIONS

The present application claims priority from Japanese Patent Application Nos. 2022-209413 filed on Dec. 27, 2022, and 2023-186612 filed on Oct. 31, 2023, the entire contents of which are incorporated herein by reference.

TECHNICAL FIELD

The present disclosure relates to a binding machine that binds a binding object such as reinforcing bars with a wire.

BACKGROUND ART

Reinforcing bars are used for a concrete structure in order to improve strength, and the reinforcing bars are bound by a wire such that the reinforcing bars do not deviate from a predetermined position during concrete placement.

Therefore, there has been proposed a binding machine referred to as a reinforcing bar binding machine, the binding machine includes a wire feeding portion that has a tubular hub around which a wire is wound and that is capable of feeding the wire from a reel rotatably supported by a magazine; and a curl arm that plastically deforms the wire fed from the wire feeding portion to draw an arc-shaped trajectory, and the binding machine binds reinforcing bars by winding the wire plastically deformed by the curl arm around the reinforcing bars and then twisting the wire (for example, see JP6566310B).

When a diameter of the reinforcing bars to be bound increases, it is necessary to increase a diameter of a feeding path of the wire annularly wound around the reinforcing bars. However, when the diameter of the annular feeding path of the wire increases, a position of the wire, which is fed from the curl arm by the feeding of the wire by the wire feeding portion, along an axial direction of the annular feeding path varies in the feeding path of the wire.

This variation is increased when the position of the wire in a direction intersecting a direction in which the wire is fed is biased in the magazine. When this variation is increased, a distal end of the wire fed from the curl arm may not enter a guide positioned below the curl arm.

The present disclosure has been made to solve such a matter, and an object thereof is to provide a binding machine that stabilizes a position of a wire in a direction intersecting a direction in which the wire is fed in a magazine.

SUMMARY

According to an aspect of the disclosure, a binding machine includes:

- a magazine configured to accommodate a wire;
- a wire feeding portion configured to feed the wire accommodated in the magazine;
- a curl forming portion configured to constitute an annular feeding path for winding the wire fed by the wire feeding portion around a binding object; and
- a binding portion configured to twist the wire wound around the binding object, wherein the curl forming portion includes a curling guide that curls the wire fed by the wire feeding portion, and a leading guide that leads the wire curled by the curling guide to the binding portion, and the magazine includes a feeding path forming portion that forms a feeding path of the wire, and a regulating portion that regulates movement of the wire in a direction intersecting a direction in which the wire is fed in the feeding path forming portion, and being along an axial direction of the annular feeding path.

With the above configuration, the movement of the wire is regulated in the direction intersecting the direction in which the wire is fed in the feeding path forming portion and being along the axial direction of the annular feeding path In the present disclosure, the movement of the wire is regulated in the direction intersecting the direction in which the wire is fed in the feeding path forming portion and being along the axial direction of the annular feeding path, and thus the position of the wire along the axial direction of the annular feeding path is stabilized in the magazine. Accordingly, the wire curled by the curling guide can be fed from the curling guide to enter the leading guide.

DESCRIPTION OF EMBODIMENTS

Hereinafter, examples of a reinforcing bar binding machine as embodiments of a binding machine according to the present disclosure will be described with reference to the drawings.

Figure 1A:
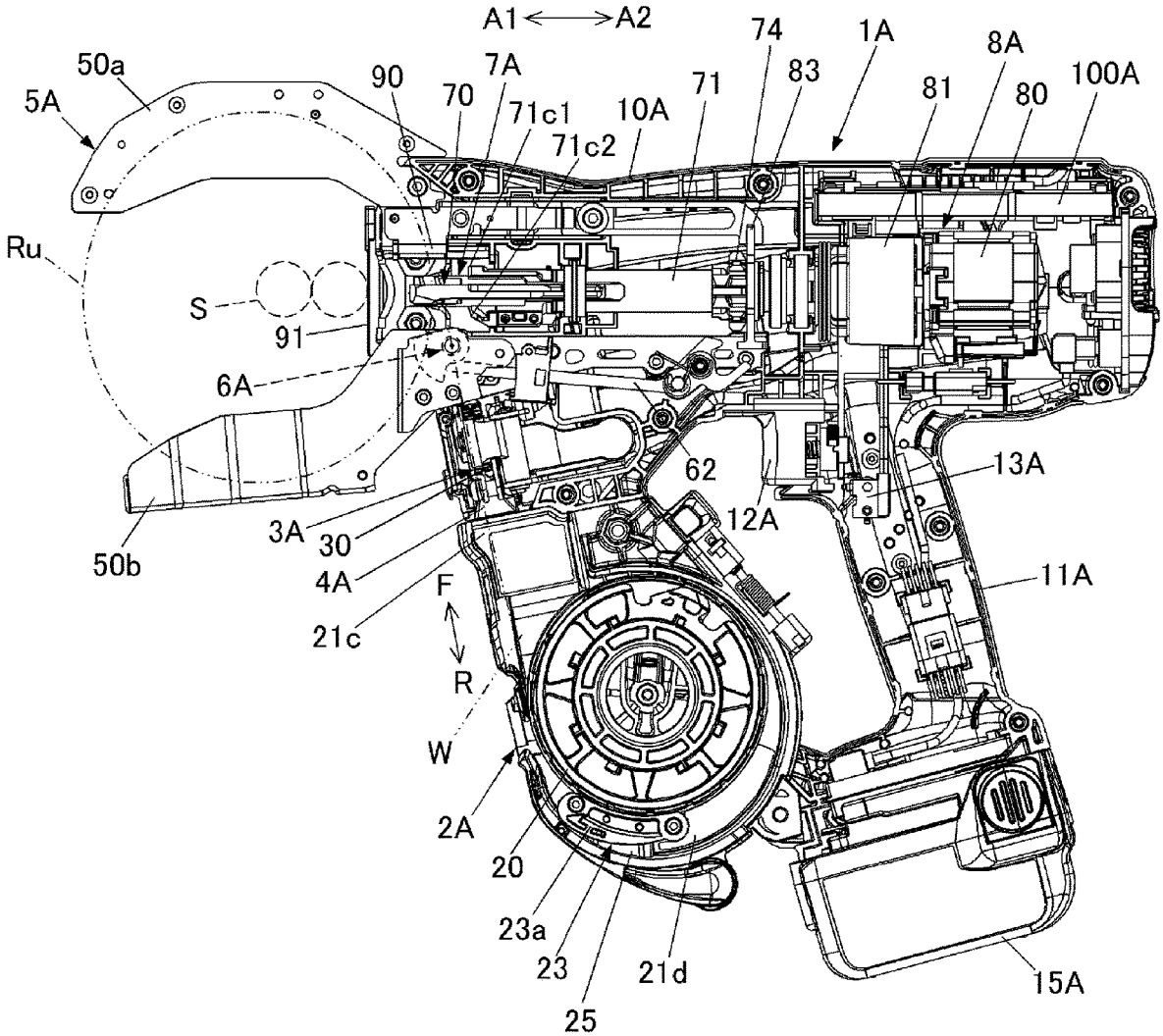
FIG. 1A is an internal configuration diagram illustrating an example of an overall configuration of a reinforcing bar binding machine according to a first embodiment when viewed from a side.
Figure 1B:
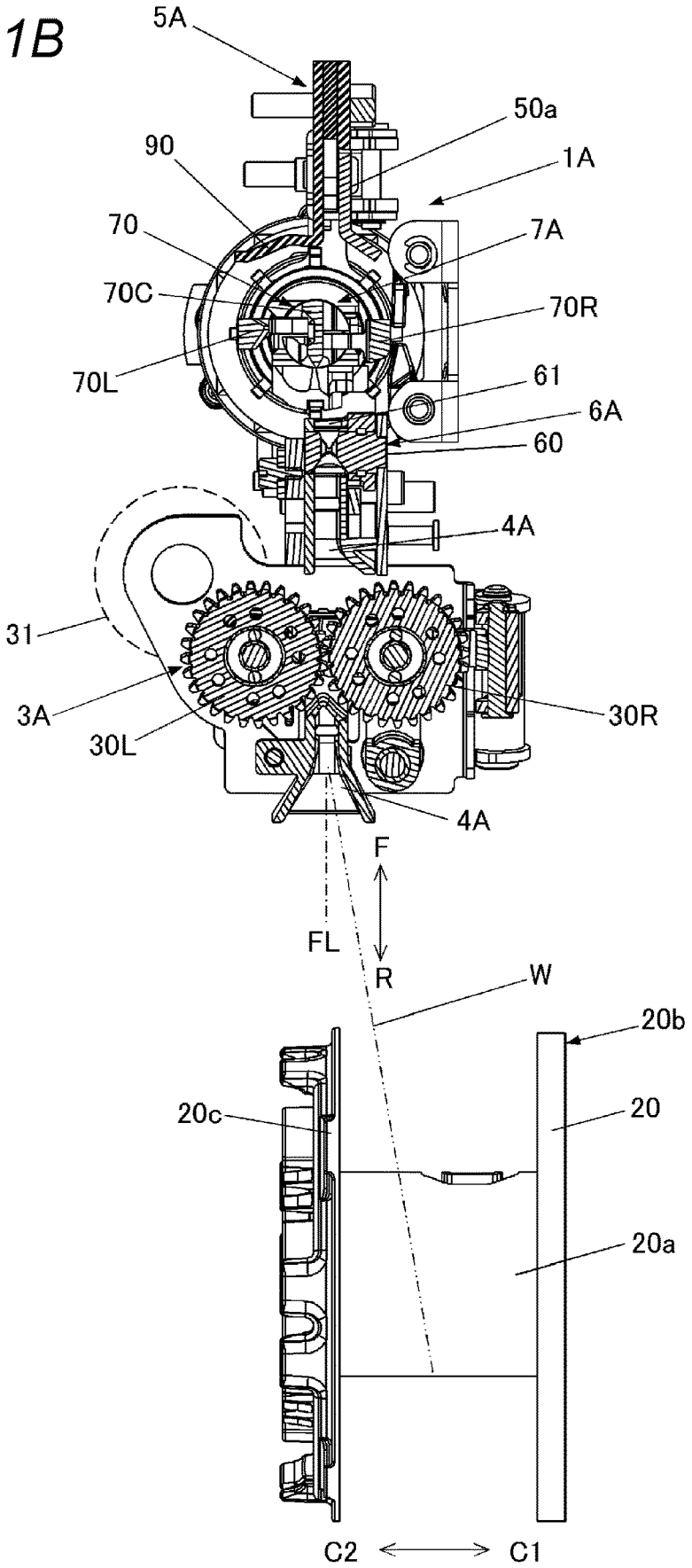
FIG. 1B is an internal configuration diagram illustrating the example of the overall configuration of the reinforcing bar binding machine according to the first embodiment when viewed from a front.
Figure 1C:
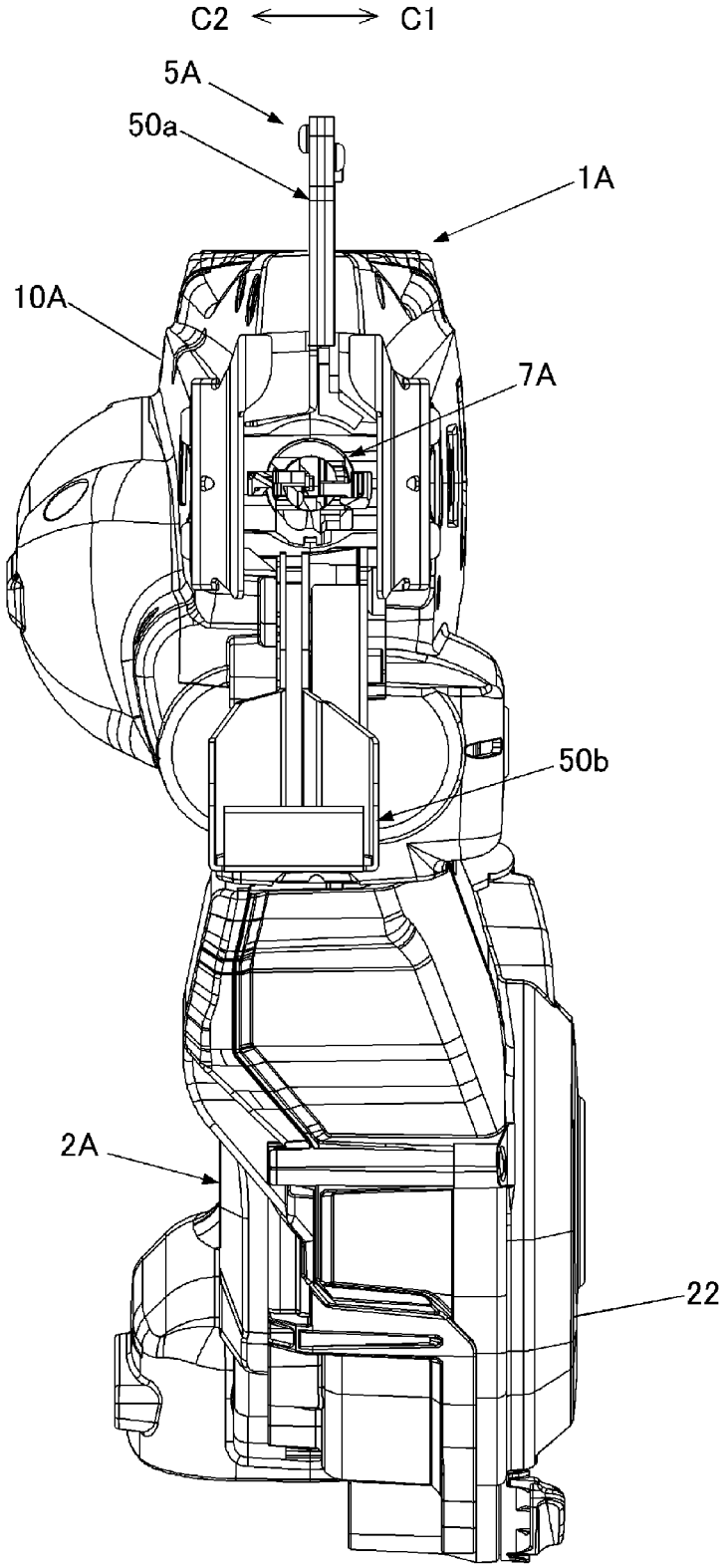
FIG. 1C is a front view illustrating the example of the overall configuration of the reinforcing bar binding machine according to the first embodiment.

Configuration Example of Reinforcing Bar Binding Machine According to First Embodiment FIG. 1A is an internal configuration diagram illustrating an example of an overall configuration of a reinforcing bar binding machine according to a first embodiment when viewed from a side, FIG. 1B is an internal configuration diagram illustrating the example of the overall configuration of the reinforcing bar binding machine according to the first embodiment when viewed from a front, and FIG. 1C is a front view illustrating the example of the overall configuration of the reinforcing bar binding machine according to the first embodiment.

A reinforcing bar binding machine 1A is used by being held by a hand of an operator and includes a main body portion 10A and a handle portion 11A. The reinforcing bar binding machine 1A feeds a wire W in a forward direction indicated by an arrow F, winds the wire W around reinforcing bars S serving as binding objects, feeds the wire W wound around the reinforcing bars S in a reverse direction indicated by an arrow R, winds the wire W around the reinforcing bars S, and then twists the wire W to bind the reinforcing bars S with the wire W. The reinforcing bar binding machine 1A binds the reinforcing bars S with a single wire W or a plurality of wires W, and in this example, two wires W.

In order to implement the above functions, the reinforcing bar binding machine 1A includes a magazine 2A in which the wires W are accommodated, a wire feeding portion 3A that feeds the two wires W side by side in a radial direction of the wires W, and a wire guide 4A that guides the two wires W fed by the wire feeding portion 3A. The reinforcing bar binding machine 1A further includes a curl forming portion 5A that constitutes an annular feeding path for winding the two wires W fed by the wire feeding portion 3A around the reinforcing bars S, and a cutting portion 6A that cuts the two wires W wound around the reinforcing bars S. The reinforcing bar binding machine 1A further includes a binding portion 7A that twists the two wires W wound around the reinforcing bars S, and a driving portion 8A that drives the binding portion 7A.

The magazine 2A rotatably and detachably accommodates a reel 20 around which the elongated wires W are wound in a manner of being capable of being drawn out. As the wire W, a wire formed of a metal wire capable of being plastically deformed, a wire obtained by coating a metal wire with a resin, or a stranded wire may be used.

The reel 20 includes a tubular hub portion 20*a* around which the wires W is wound, and a pair of flange portions 20*b* and 20*c* integrally provided at both end sides of the hub portion 20*a* in an axial direction. The flange portions 20*b* and 20*c* have a substantially circular plate shape having a larger diameter than that of the hub portion 20*a*, and are provided concentrically with the hub portion 20*a*. In the reel 20, the two wires W are wound around the hub portion 20*a*, and the two wires W can be simultaneously pulled out from the reel 20.

As illustrated in FIG. 1C, in the reinforcing bar binding machine 1A, the magazine 2A is disposed to be offset in a first direction indicated by an arrow C1 which is one direction with respect to a curling guide 50*a* of the curl forming portion 5A to be described later. Accordingly, as illustrated in FIG. 1B, the reel 20 is attached to the reinforcing bar binding machine 1A in a state in which the reel 20 is offset in the first direction indicated by the arrow C1 along an axial direction of the reel 20 along the axial direction of the hub portion 20*a* with respect to a feeding path FL of the wires W defined by the wire feeding portion 3A, the wire guide 4A, and the like.

The wire feeding portion 3A includes a pair of feeding gears 30 (30L and 30R) that sandwich and feed the two wires W arranged in parallel. In the wire feeding portion 3A, a rotation operation of a feeding motor 31 is transmitted to the feeding gear 30L. Further, a rotation operation of the feeding gear 30L is transmitted to the feeding gear 30R by meshing of gear portions provided on outer peripheries of the feeding gear 30L and the feeding gear 30R. Accordingly, the feeding gear 30L serves as a driving side and the feeding gear 30R serves as a driven side.

The wire feeding portion 3A causes the two wires W to be arranged in parallel along a direction in which the pair of feeding gears 30L and 30R are arranged. In the wire feeding portion 3A, one of the wires W is in contact with a groove portion of the feeding gear 30L, the other one of the wires W is in contact with a groove portion of the feeding gear 30R, and the one wire W and the other wire W are in contact with each other. Accordingly, by rotation of the pair of feeding gears 30 (30L and 30R), the wire feeding portion 3A feeds the two wires W sandwiched between the pair of feeding gears 30 (30L and 30R) along an extension direction of the wires W by a frictional force generated between the feeding gear 30L and the one wire W, a frictional force generated between the feeding gear 30R and the other wire W, and a frictional force generated between the two wires W.

In the wire feeding portion 3A, a rotation direction of the feeding gears 30 is switched by switching a rotation direction of the feeding motor 31 between the forward and reverse directions, and a feeding direction of the wires W is switched between the forward and reverse directions.

The wire guide 4A is arranged on an upstream side and a downstream side of the feeding gears 30 with respect to the feeding direction of the wires W fed in the forward direction. The wire guide 4A guides the two wires W, which enter the wire guide 4A, between the pair of feeding gears 30 in such a manner that the two wires W are arranged in parallel along the direction in which the pair of feeding gears 30 are arranged.

In the wire guide 4A, an opening area of an opening on the upstream side with respect to the feeding direction of the wires W fed in the forward direction is larger than that of an opening on the downstream side, and a part or all of an inner surface of the opening is tapered. Accordingly, an operation of inserting the wires W pulled out from the reel 20 accommodated in the magazine 2A into the wire guide 4A can be easily performed.

The curl forming portion 5A includes the curling guide 50*a* that curls the two wires W fed by the wire feeding portion 3A and regulates a direction in which the two wires W are arranged in parallel, and a leading guide 50*b* that leads the two wires W, which are curled by the curling guide 50*a*, to the binding portion 7A. The curl forming portion 5A forms an annular feeding path Ru as indicated by a two-dot chain line in FIG. 1A from the curling guide 50*a* to the binding portion 7A through the leading guide 50*b* by curling the two wires W which are fed by the wire feeding portion 3A and pass through the curling guide 50*a*.

The cutting portion 6A includes a fixed blade portion 60, a movable blade portion 61 that cuts the wires W in cooperation with the fixed blade portion 60, and a transmission mechanism 62 that transmits an operation of the binding portion 7A to the movable blade portion 61. The cutting portion 6A cuts the wires W by a rotation operation of the movable blade portion 61 with the fixed blade portion 60 as a fulcrum shaft.

The binding portion 7A includes a wire locking body 70 in which the wires W are locked, and a sleeve 71 that actuates the wire locking body 70. The driving portion 8A includes a motor 80 and a speed reducer 81 that performs deceleration and torque amplification.

The reinforcing bar binding machine 1A includes a wire abutting portion 90 against which distal ends of the wires W abut, at a terminal end of the feeding path of the wires W which pass through the annular feeding path Ru and which are locked by the wire locking body 70. In the reinforcing bar binding machine 1A, the curling guide 50*a* and the leading guide 50*b* of the curl forming portion 5A described above are provided at a front side end portion of the main body portion 10A. Further, in the reinforcing bar binding machine 1A, a reinforcing bar abutting portion 91 against which the reinforcing bars S abut is provided between the curling guide 50*a* and the leading guide 50*b* at the front side end portion of the main body portion 10A.

In the reinforcing bar binding machine 1A, the handle portion 11A extends downward from the main body portion 10A. Further, a battery 15A is detachably attached to a lower portion of the handle portion 11A. In the reinforcing bar binding machine 1A, the magazine 2A is provided on a forward side of the handle portion 11A. In the reinforcing bar binding machine 1A, the wire feeding portion 3A, the cutting portion 6A, the binding portion 7A, the driving portion 8A that drives the binding portion 7A, and the like described above are accommodated in the main body portion 10A.

In the reinforcing bar binding machine 1A, a trigger 12A is provided on a front side of the handle portion 11A, and a switch 13A is provided inside the handle portion 11A. In the reinforcing bar binding machine 1A, a controller 100A controls the feeding motor 31 and the motor 80 in accordance with a state of the switch 13A pressed by an operation of the trigger 12A.

Main Portion Configuration Example of Reinforcing Bar Binding Machine According to the Present Embodiment

Configuration Example of Magazine

Figure 2A:
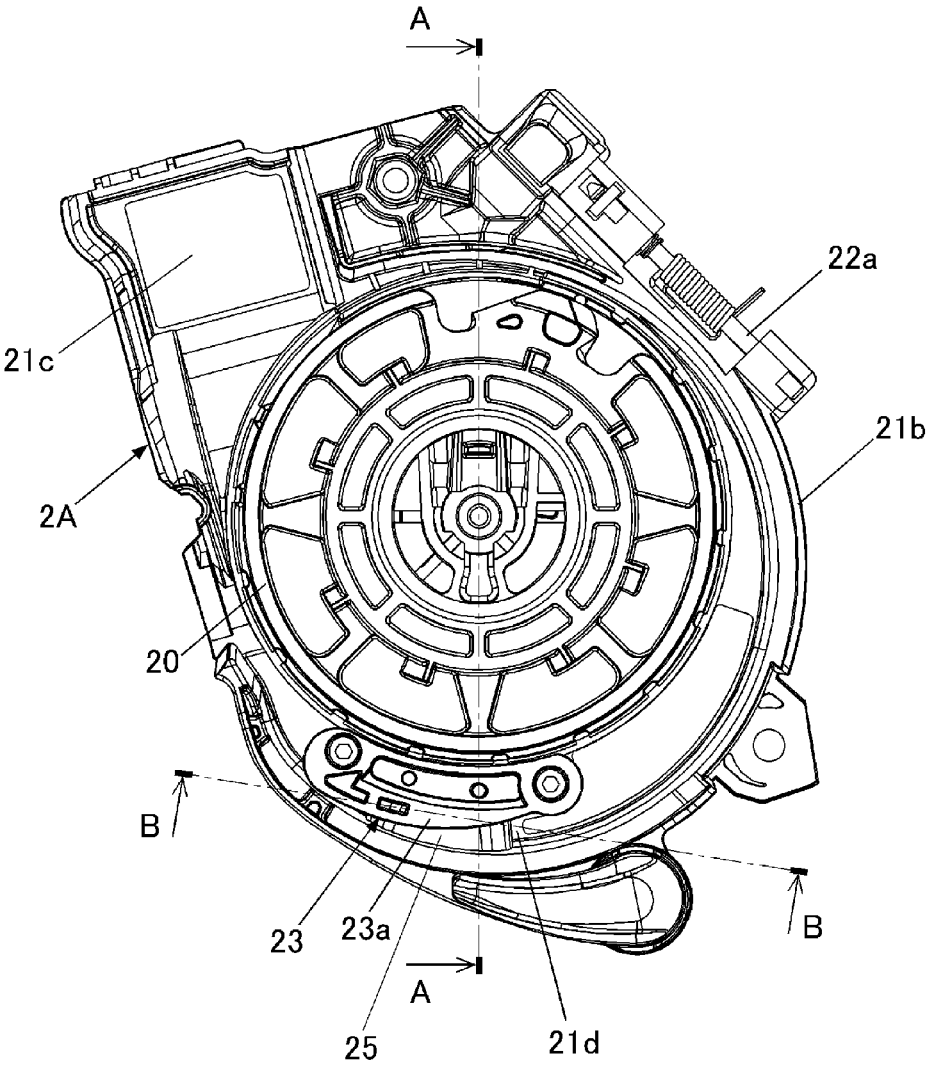
FIG. 2A is a side view illustrating an example of a magazine according to the first embodiment.
Figure 2B:
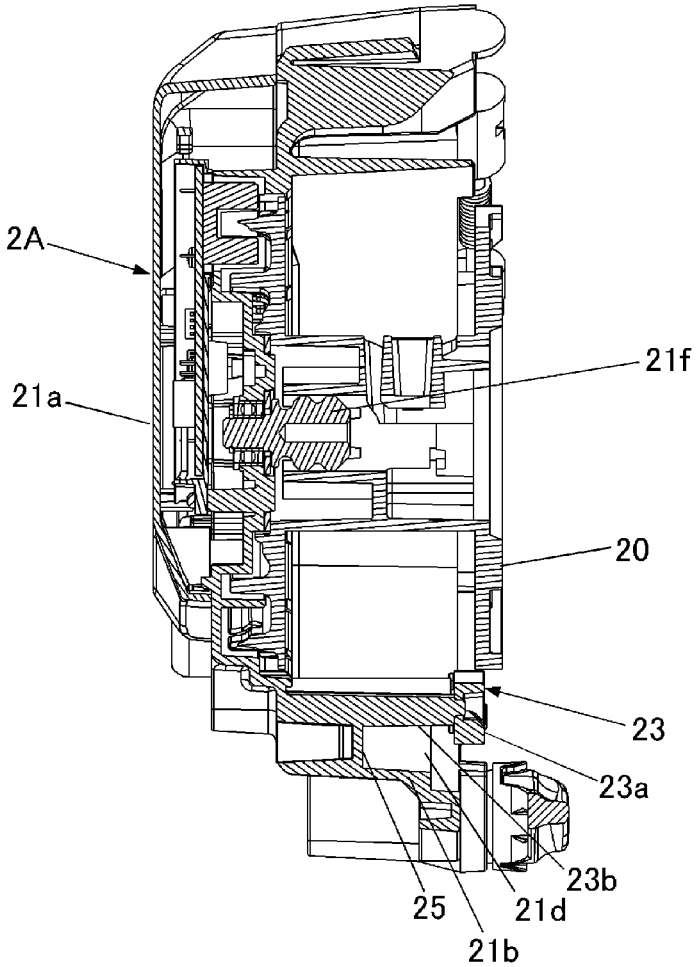
FIG. 2B is a cross-sectional view taken along a line A-A of FIG. 2A.
Figure 2C:
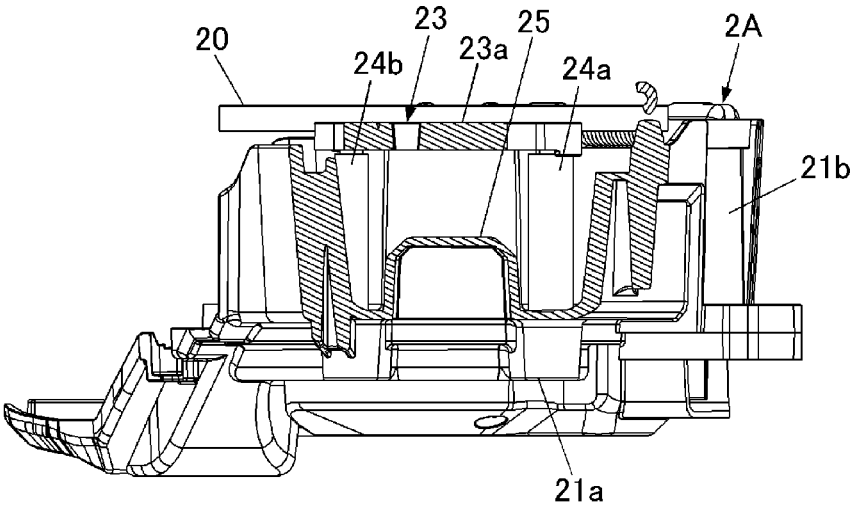
FIG. 2C is a cross-sectional view taken along a line B-B of FIG. 2A.
Figure 2D:
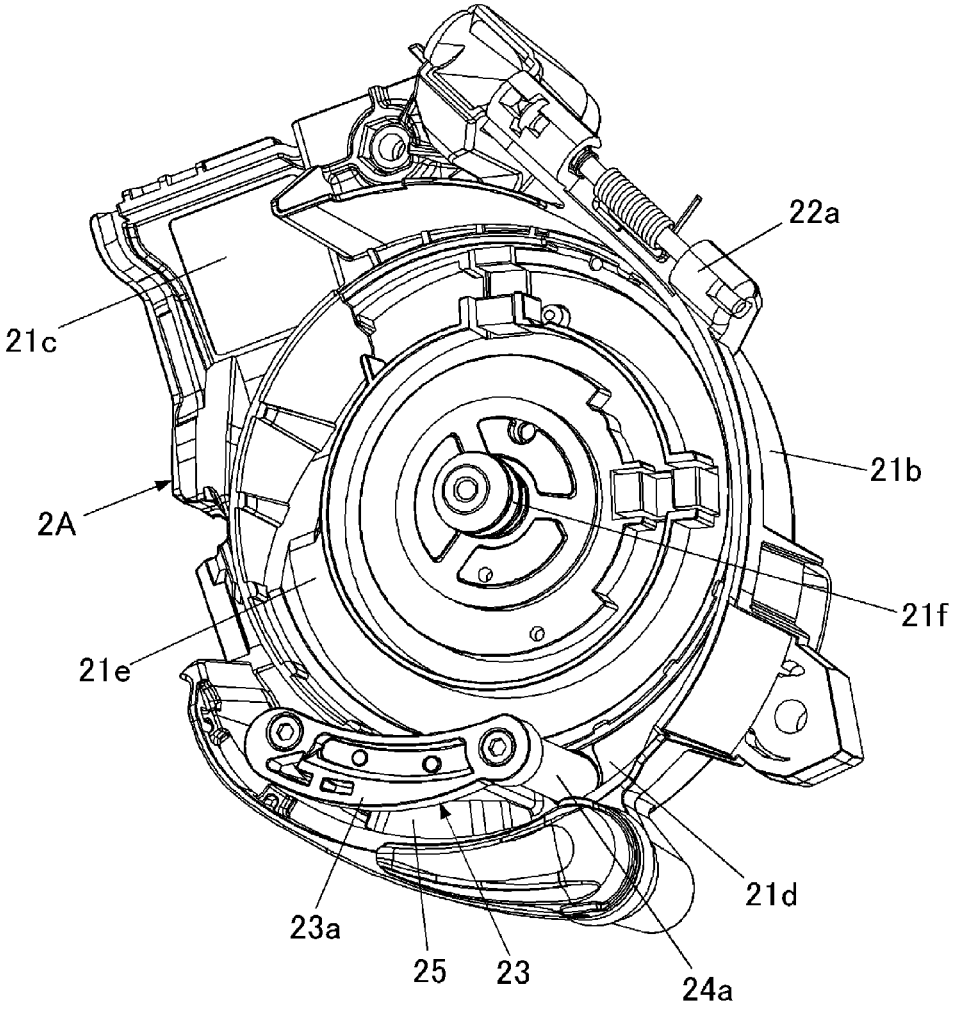
FIG. 2D is a perspective view illustrating the example of the magazine according to the first embodiment.
Figure 3A:
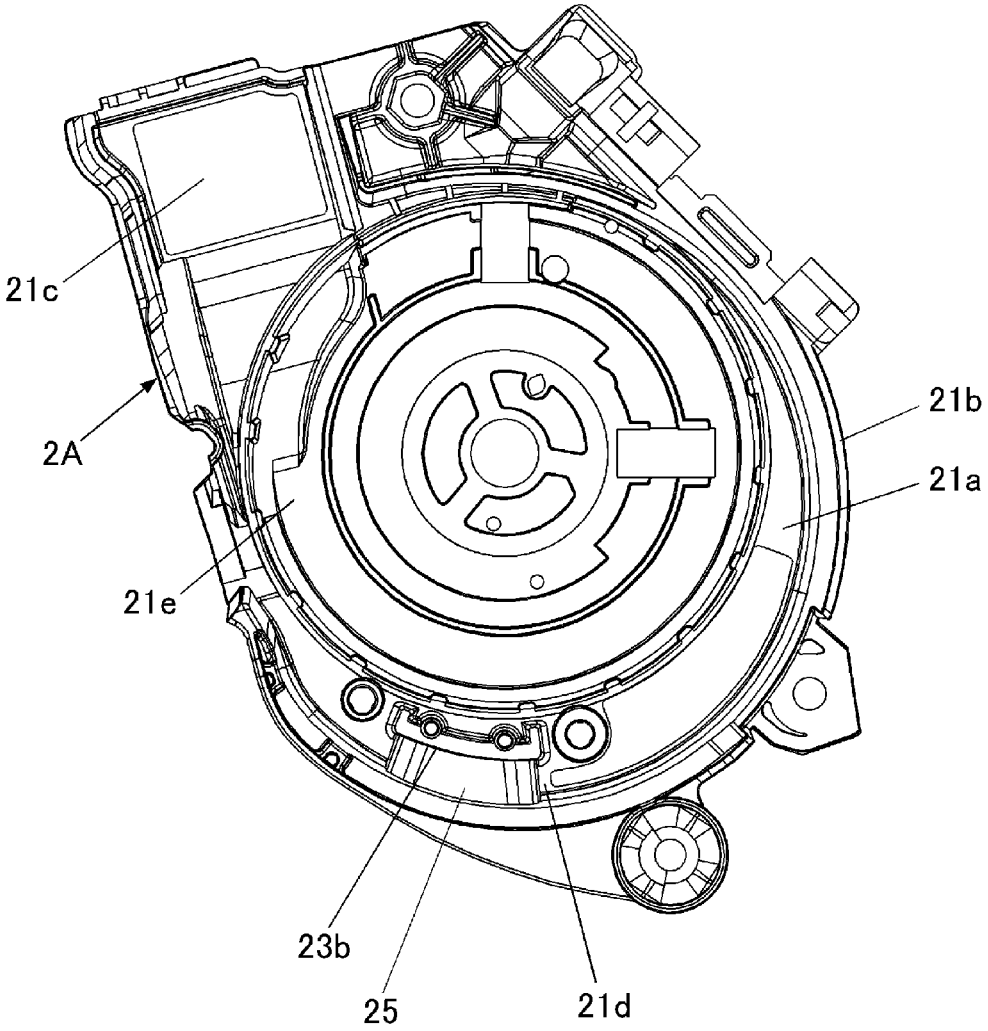
FIG. 3A is a side view illustrating the example of the magazine according to the first embodiment in a state in which parts are removed.
Figure 3B:
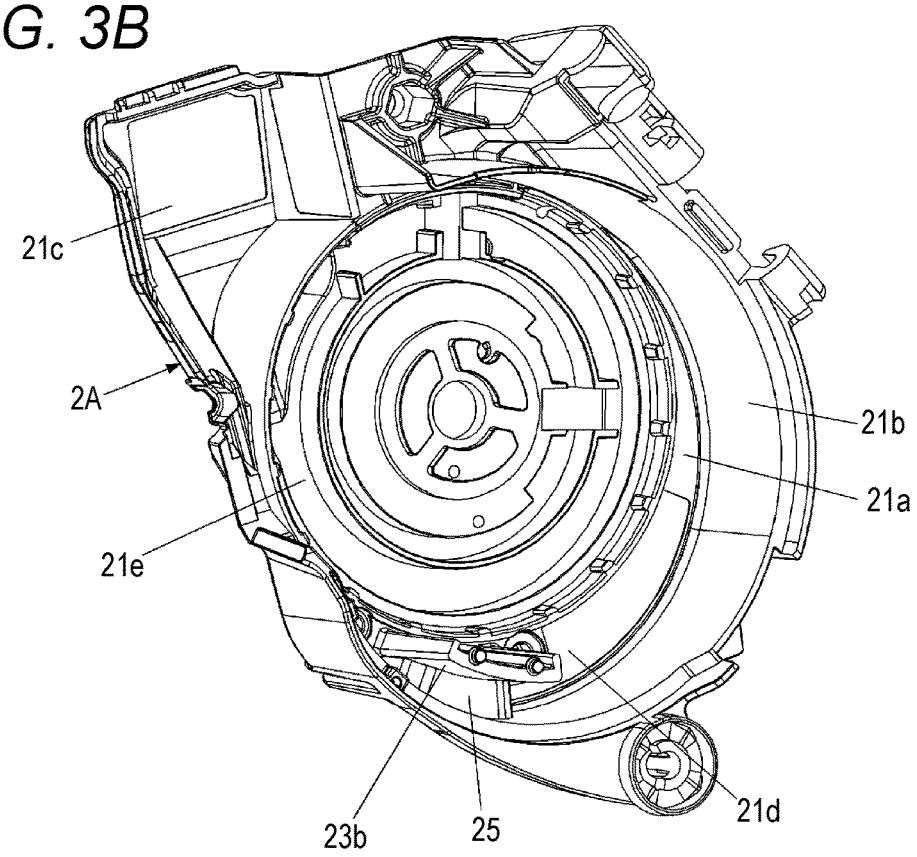
FIG. 3B is a perspective view illustrating the example of the magazine according to the first embodiment in the state in which the parts are removed.
Figure 3C:
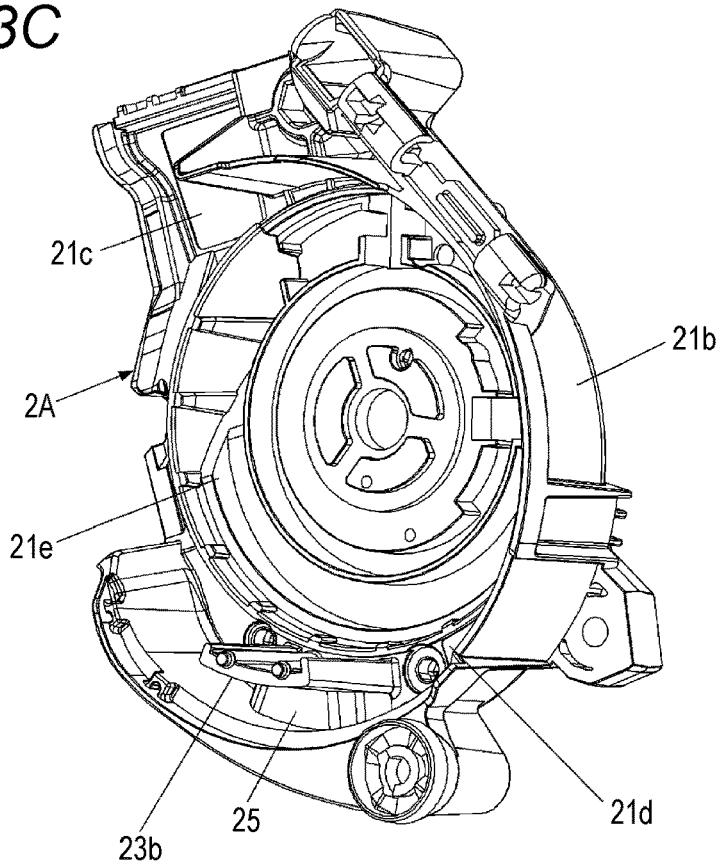
FIG. 3C is a perspective view illustrating the example of the magazine according to the first embodiment in the state in which the parts are removed.

FIG. 2A is a side view illustrating an example of a magazine according to the first embodiment, FIG. 2B is a cross-sectional view taken along a line A-A of FIG. 2A, FIG. 2C is a cross-sectional view taken along a line B-B of FIG. 2A, and FIG. 2D is a perspective view illustrating the example of the magazine according to the first embodiment. Further, FIG. 3A is a side view illustrating the example of the magazine according to the first embodiment in a state in which parts are removed, and FIGS. 3B and 3C are perspective views illustrating the example of the magazine according to the first embodiment in the state in which the parts are removed.

The magazine 2A according to the first embodiment includes a shaft portion 21*f* that rotatably supports the reel 20 with respect to the magazine 2A. The magazine 2A includes a side wall portion 21*a* on one side portion along a rotation axis of the reel 20 defined by the shaft portion 21*f*. In the magazine 2A, the side wall portion 21*a* closes a side portion in a second direction indicated by an arrow C2, the second direction is a direction opposite to the first direction in which the reel 20 is offset. In addition, the magazine 2A includes a peripheral wall portion 21*b* erected from the side wall portion 21*a* along a rotation circumferential direction of the reel 20.

Further, the magazine 2A includes a lid portion 22 that opens and closes the other side portion along the rotation axis of the reel 20. In the magazine 2A, the lid portion 22 is provided in a side portion in the first direction in which the reel 20 is offset, and opens and closes an opening of the magazine 2A by a rotation operation with a hinge portion 22*a* provided in the peripheral wall portion 21*b* as a fulcrum. In the magazine 2A, the reel 20 can be attached and detached by opening the lid portion 22.

In the magazine 2A, a space having a size allowing the reel 20 to rotate is formed by the side wall portion 21*a*, the peripheral wall portion 21*b*, and the lid portion 22 in a closed state.

In addition, the magazine 2A includes a feeding port 21*c* for the wires W on a side where the magazine 2A is connected to the wire feeding portion 3A. Further, the magazine 2A includes a feeding path forming portion 21*d* that forms the feeding path for the wires W pulled out from the reel 20, on a side opposite to the feeding port 21*c* with an accommodation position 21*e* of the reel 20 interposed between the feeding port 21*c* and the feeding path forming portion 21*d*. The feeding path forming portion 21*d* is constituted by a space between the reel 20 and the peripheral wall portion 21*b*.

The magazine 2A includes a separating portion 23 in the feeding path forming portion 21*d*. The separating portion 23 includes a protruding portion 23*b* protruding in the first direction indicated by the arrow C1 from the side wall portion 21*a* toward the feeding path forming portion 21*d* of the magazine 2A. The protruding portion 23*b* protrudes in the axial direction of the reel 20 along the peripheral wall portion 21*b*.

In the magazine 2A, the feeding path forming portion 21*d* positioned on the side opposite to the feeding port 21*c* is a range in which the wires W are easily bent by an operation of feeding the wires W in the reverse direction indicated by the arrow R, and is a range in which the bent wires W are easily displaced in a direction approaching the wires W wound around the reel 20 by a next operation of feeding the wires W in the forward direction indicated by the arrow F. Therefore, the separating portion 23 is provided in the feeding path forming portion 21*d*. The separating portion 23 separates the reel 20 accommodated in the magazine 2A and the wires W bent by the feeding path forming portion 21*d*.

With respect to the protruding portion 23*b*, the separating portion 23 includes a rotating member 24*a* on the upstream side in the feeding direction of the wires W indicated by the arrow F, and includes a rotating member 24*b* on the downstream side in the feeding direction of the wires W indicated by the arrow F. The rotating members 24*a* and 24*b* are rotatably provided such that rotation axes thereof extend in a direction intersecting the feeding direction of the wires W, and the wires W fed in the forward direction or the reverse direction come into contact with outer peripheral surfaces thereof.

The separating portion 23 includes a pressing member 23*a* that rotatably supports the rotating members 24*a* and 24*b*. The pressing member 23*a* is attached to a portion of the protruding portion 23*b* opposite to the side wall portion 21*a*. Regarding the rotating members 24*a* and 24*b*, one side along an axial direction is rotatably supported by the side wall portion 21*a*, and the other side along the axial direction is rotatably supported by the pressing member 23*a*. In the separating portion 23, a mark for leading a loading path of the wires W is provided in the pressing member 23*a* in the form of a plane or a solid.

The magazine 2A includes a regulating portion 25 that regulates movement of the wires W in the second direction indicated by the arrow C2, the second direction intersects a direction in which the wires W are fed in the feeding path forming portion 21*d*, and is along the axial direction of the reel 20 and the axial direction of the annular feeding path Ru. The regulating portion 25 is provided corresponding to a position at which the separating portion 23 is provided in the feeding path forming portion 21*d*, and is constituted by a protrusion protruding in the first direction indicated by the arrow C1 from the side wall portion 21*a* toward the feeding path forming portion 21*d*. The regulating portion 25 is formed integrally with, for example, the side wall portion 21*a*.

The regulating portion 25 is provided on an outer side along a radial direction of the reel 20 with respect to the protruding portion 23*b* between the rotating member 24*a* and the rotating member 24*b*. The regulating portion 25 may be formed integrally with the side wall portion 21*a* and the protruding portion 23*b*. In addition, with respect to the feeding path of the wires W defined by the wires W coming into contact with the outer peripheral surface of at least one of the rotating member 24*a* and the rotating member 24*b*, the regulating portion 25 includes the feeding path, and is provided on the outer side along the radial direction of the reel 20, or both the outer side and an inner side thereof. A length of the regulating portion 25 along the circumferential direction of the reel 20 is shorter than a length between the rotating member 24*a* and the rotating member 24*b*, and the regulating portion 25 protrudes in the axial direction of the reel 20 along the peripheral wall portion 21*b* from the side wall portion 21*a* between the rotating member 24*a* and the rotating member 24*b*. A protrusion height of the regulating portion 25 from the side wall portion 21*a* is about half a length of the reel 20 in the axial direction.

Configuration Example of Binding Portion

Figure 4A:
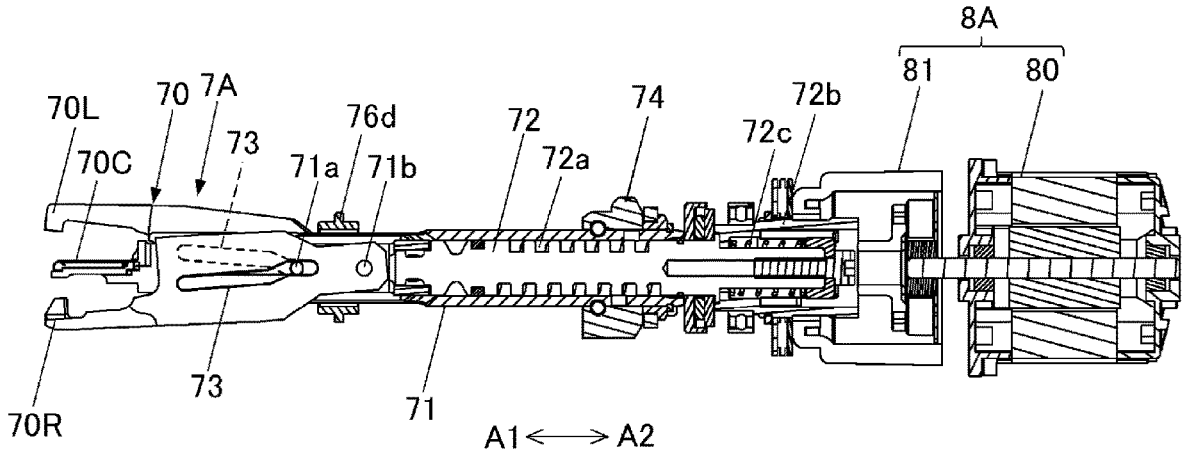
FIG. 4A is a cross-sectional plan view illustrating an example of a binding portion and a driving portion.
Figure 4B:
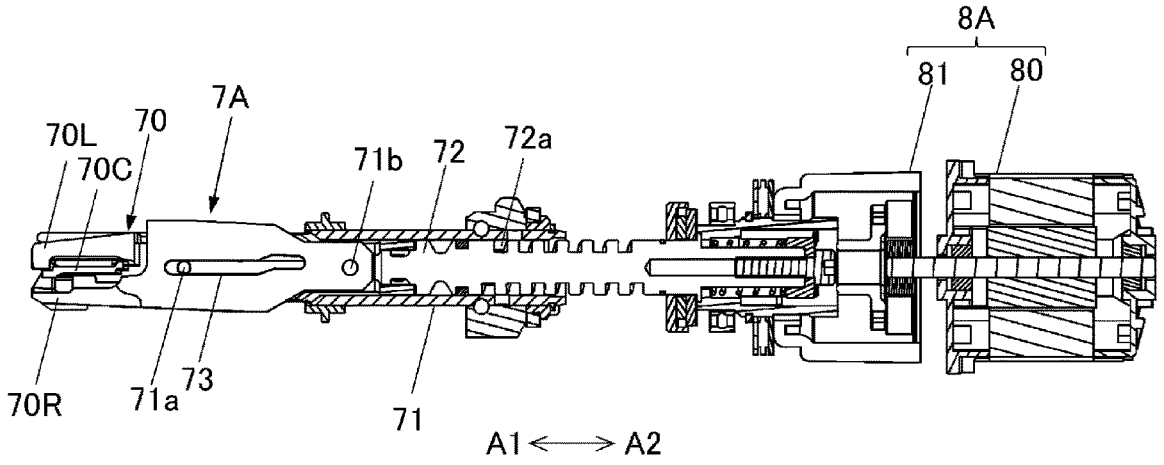
FIG. 4B is a cross-sectional plan view illustrating the example of the binding portion and the driving portion.

FIGS. 4A and 4B are cross-sectional plan views illustrating an example of the binding portion 7A and the driving portion 8A. Next, configurations of the binding portion 7A and the driving portion 8A will be described with reference to FIGS. 4A and 4B.

The binding portion 7A includes a rotation shaft 72 that actuates the wire locking body 70 and the sleeve 71. The rotation shaft 72 is coupled to the speed reducer 81 via a coupling portion 72*b* that is rotatable integrally with the speed reducer 81 and is movable in an axial direction with respect to the speed reducer 81. The coupling portion 72*b* includes a spring 72*c* that biases the rotation shaft 72 to a rearward side, which is a direction approaching the speed reducer 81, and regulates a position of the rotation shaft 72 along the axial direction. Accordingly, the rotation shaft 72 is movable to a forward side, which is a direction away from the speed reducer 81, while receiving a force to be pressed to the rearward side by the spring 72*c*. Accordingly, when a force for moving the wire locking body 70 to the forward side along the axial direction is applied to the rotation shaft 72, the rotation shaft 72 can move to the forward side while receiving the force to be pressed to the rearward side by the spring 72*c*.

The wire locking body 70 includes a center hook 70C coupled to the rotation shaft 72, and a first side hook 70R and a second side hook 70L that open and close with respect to the center hook 70C.

The center hook 70C is coupled to a distal end of the rotation shaft 72, which is one end portion of the rotation shaft 72 in the axial direction, via a configuration capable of rotating with respect to the rotation shaft 72 and capable of moving integrally with the rotation shaft 72 in the axial direction.

In the wire locking body 70, by a rotation operation with a shaft 71*b* as a fulcrum, a distal end side of the first side hook 70R opens and closes in a direction in which the distal end side of the first side hook 70R comes into contact with or separates from the center hook 70C. A distal end side of the second side hook 70L opens and closes in a direction in which the distal end side of the second side hook 70L comes into contact with or separates from the center hook 70C.

The sleeve 71 includes a protrusion (not illustrated) protruding to an inner peripheral surface of a space into which the rotation shaft 72 is inserted, and the protrusion enters a groove portion of a feeding screw 72*a* formed along the axial direction on an outer periphery of the rotation shaft 72. The sleeve 71 is supported by a support member 76*d* in a manner of being rotatable and slidable in the axial direction. When the rotation shaft 72 rotates, the sleeve 71 is moved in a direction along the axial direction of the rotation shaft 72, in accordance with a rotation direction of the rotation shaft 72 due to an action of the protrusion (not illustrated) and the feeding screw 72*a* of the rotation shaft 72. The sleeve 71 rotates integrally with the rotation shaft 72.

The sleeve 71 includes an opening and closing pin 71*a* that opens and closes the first side hook 70R and the second side hook 70L.

The opening and closing pin 71*a* is inserted into an opening and closing guide hole 73 provided in the first side hook 70R and the second side hook 70L. The opening and closing guide hole 73 extends along a moving direction of the sleeve 71 and has a shape that converts a linear motion of the opening and closing pin 71*a*, which is moved in conjunction with the sleeve 71, into an opening and closing operation due to rotation of the first side hook 70R and the second side hook 70L with the shaft 71*b* as a fulcrum.

In the wire locking body 70, when the sleeve 71 is moved in a downward direction indicated by an arrow A2, the first side hook 70R and the second side hook 70L are moved in a direction away from the center hook 70C by the rotation operation with the shaft 71*b* as a fulcrum due to a trajectory of the opening and closing pin 71*a* and the shape of the opening and closing guide hole 73.

Accordingly, the first side hook 70R and the second side hook 70L are opened with respect to the center hook 70C, and the feeding path through which the wires W pass is formed between the first side hook 70R and the center hook 70C and between the second side hook 70L and the center hook 70C.

In a state in which the first side hook 70R and the second side hook 70L are opened with respect to the center hook 70C, the wires W fed by the wire feeding portion 3A pass between the center hook 70C and the first side hook 70R. The wires W that pass between the center hook 70C and the first side hook 70R are led to the curl forming portion 5A. The wires W curled by the curling guide 50*a* and led to the binding portion 7A by the leading guide 50*b* pass between the center hook 70C and the second side hook 70L.

In the wire locking body 70, when the sleeve 71 is moved in an upward direction indicated by an arrow A1, the first side hook 70R and the second side hook 70L are moved in a direction in which the first side hook 70R and the second side hook 70L approach the center hook 70C by the rotation operation with the shaft 71*b* as a fulcrum due to the trajectory of the opening and closing pin 71*a* and the shape of the opening and closing guide hole 73. Accordingly, the first side hook 70R and the second side hook 70L are closed with respect to the center hook 70C.

When the first side hook 70R is closed with respect to the center hook 70C, the wires W sandwiched between the first side hook 70R and the center hook 70C are locked in a manner of being capable of moving between the first side hook 70R and the center hook 70C. When the second side hook 70L is closed with respect to the center hook 70C, the wires W sandwiched between the second side hook 70L and the center hook 70C are locked in a manner that the wires W are not removed from a portion between the second side hook 70L and the center hook 70C.

The sleeve 71 includes a bending portion 71*c*1 that forms the wires W into a predetermined shape by pressing and bending a distal end side, which is one end portion of the wires W, in a predetermined direction, and a bending portion 71*c*2 that forms the wires W into a predetermined shape by pressing and bending a terminal end side, which is the other end portion of the wires W cut by the cutting portion 6A, in a predetermined direction.

When the sleeve 71 is moved in the upward direction indicated by the arrow A1, the distal end side of the wires W locked by the center hook 70C and the second side hook 70L is pressed by the bending portion 71*c*1 and is bent toward the reinforcing bars S. When the sleeve 71 is moved in the upward direction indicated by the arrow A1, the terminal end side of the wires W, which is locked by the center hook 70C and the first side hook 70R and cut by the cutting portion 6A, is pressed by the bending portion 71*c*2 and is bent toward the reinforcing bars S.

The binding portion 7A includes a rotation regulating portion 74 that regulates the rotations of the wire locking body 70 and the sleeve 71 which are in conjunction with a rotation operation of the rotation shaft 72. In the binding portion 7A, the rotation regulating portion 74 regulates the rotation of the sleeve 71 which is in conjunction with the rotation of the rotation shaft 72 according to a position of the sleeve 71 along the axial direction of the rotation shaft 72, and the sleeve 71 is moved in the directions indicated by the arrow A1 and the arrow A2 by the rotation operation of the rotation shaft 72.

Accordingly, the sleeve 71 is moved in the direction indicated by the arrow A1 without rotating, whereby the first side hook 70R and the second side hook 70L are closed with respect to the center hook 70C, and the wires W are locked. The sleeve 71 is moved in the direction indicated by the arrow A2 without rotating, whereby the first side hook 70R and the second side hook 70L are opened with respect to the center hook 70C, and the locking of the wires W is released.

In the binding portion 7A, when the regulation of the rotation of the sleeve 71 by the rotation regulating portion 74 is released, the sleeve 71 rotates in conjunction with the rotation of the rotation shaft 72.

Accordingly, the first side hook 70R and the second side hook 70L, which lock the wires W, and the center hook 70C rotate, and the locked wires W are twisted.

Figure 5A:
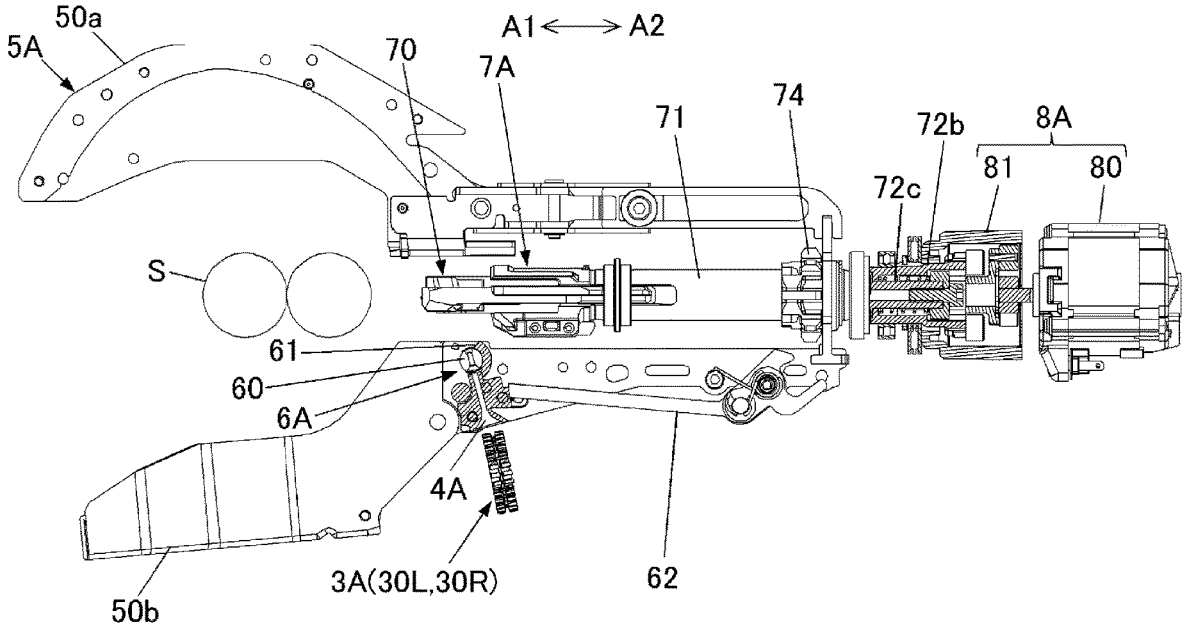
FIG. 5A is a main portion side cross-sectional view illustrating an example of an operation of the reinforcing bar binding machine according to the first embodiment.
Figure 5B:
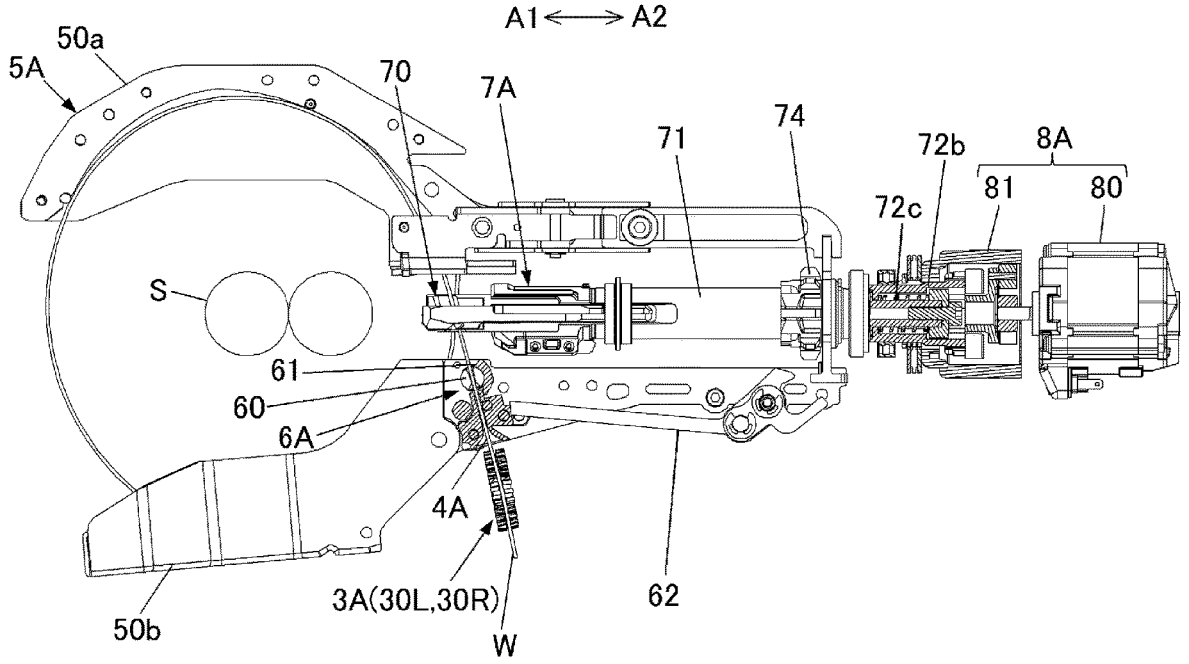
FIG. 5B is a main portion side cross-sectional view illustrating an example of an operation of the reinforcing bar binding machine according to the first embodiment.
Figure 5C:
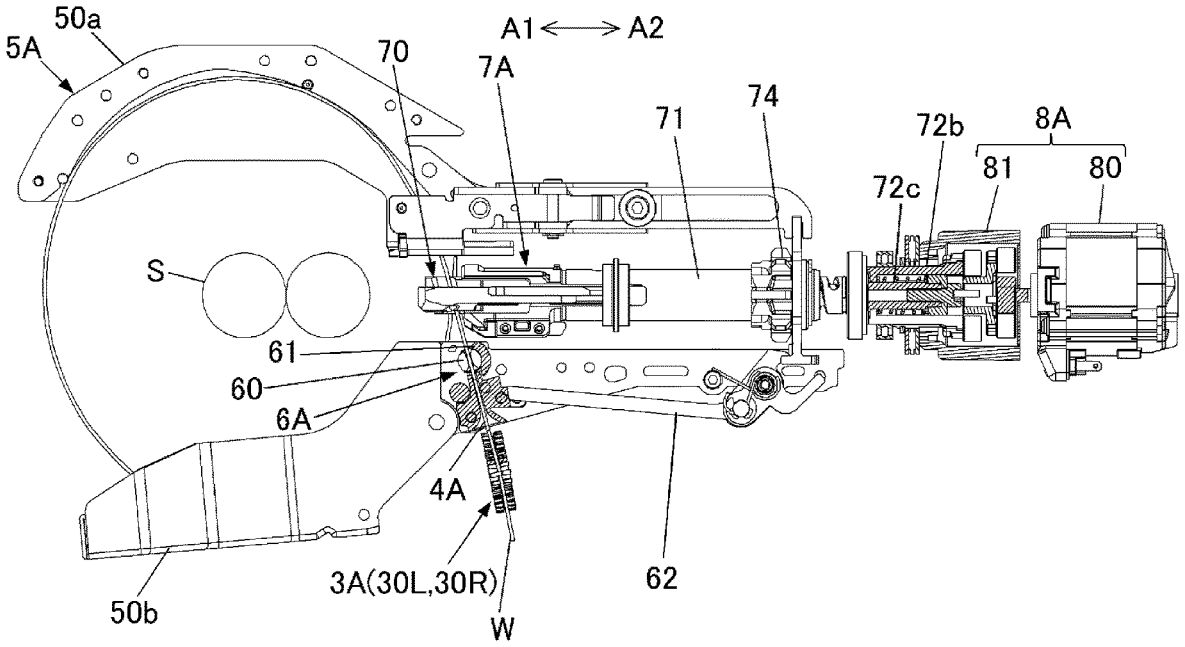
FIG. 5C is a main portion side cross-sectional view illustrating an example of an operation of the reinforcing bar binding machine according to the first embodiment.
Figure 5D:
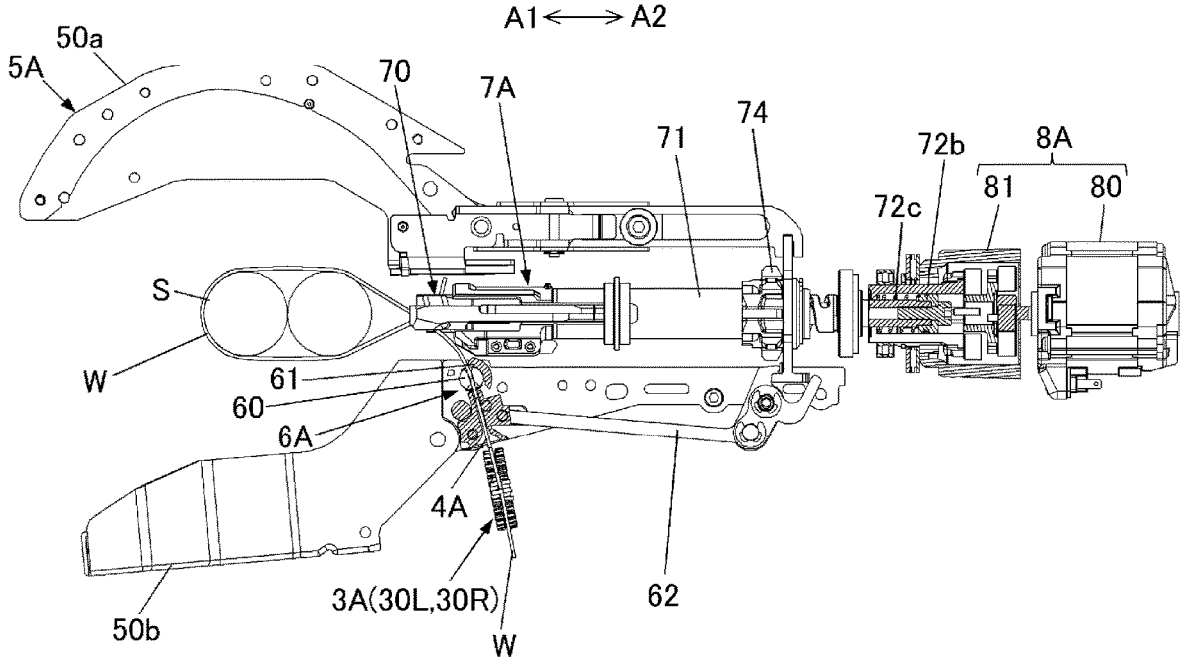
FIG. 5D is a main portion side cross-sectional view illustrating an example of an operation of the reinforcing bar binding machine according to the first embodiment.
Figure 5E:
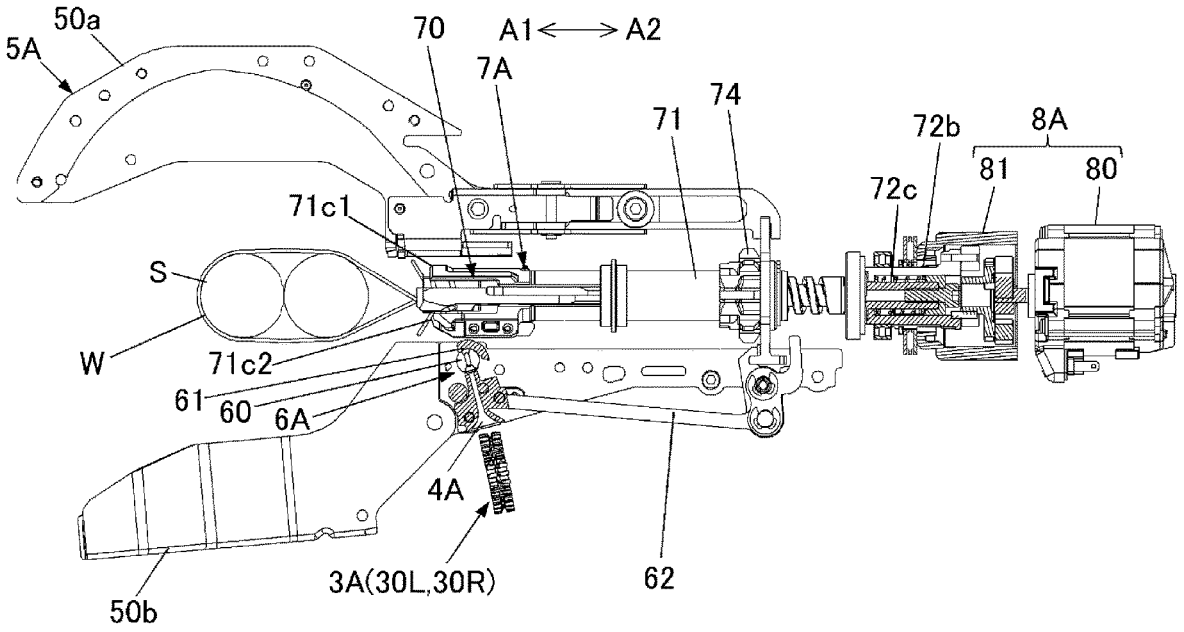
FIG. 5E is a main portion side cross-sectional view illustrating an example of an operation of the reinforcing bar binding machine according to the first embodiment.
Figure 5F:
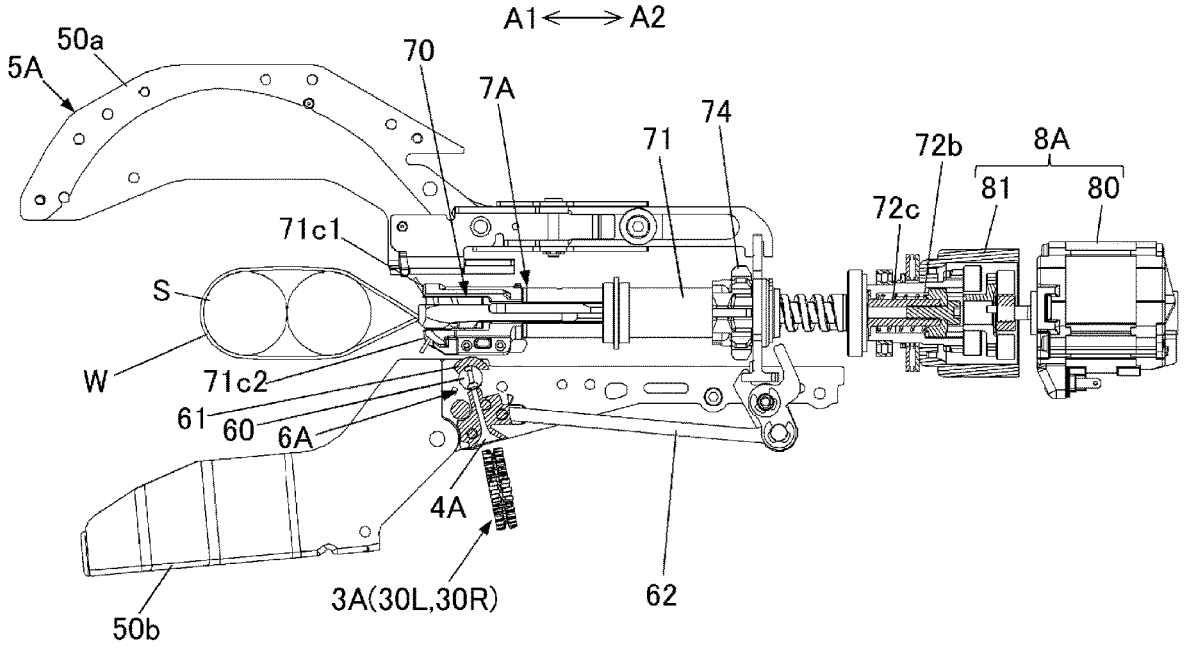
FIG. 5F is a main portion side cross-sectional view illustrating an example of an operation of the reinforcing bar binding machine according to the first embodiment.
Figure 5G:
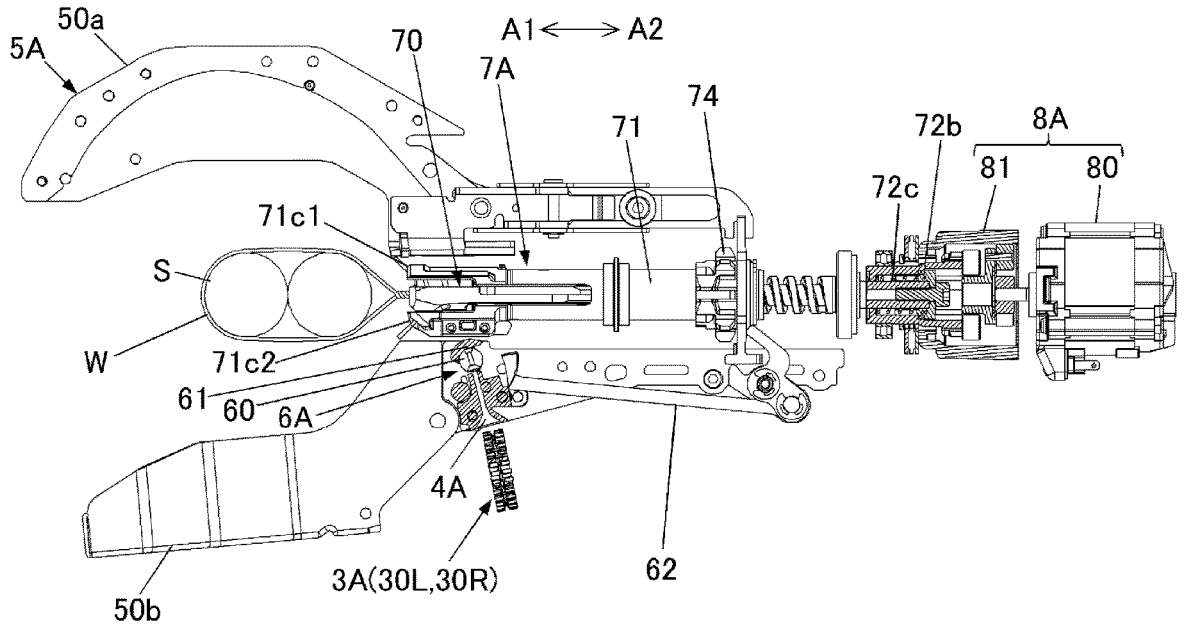
FIG. 5G is a main portion side cross-sectional view illustrating an example of an operation of the reinforcing bar binding machine according to the first embodiment.
Figure 5H:
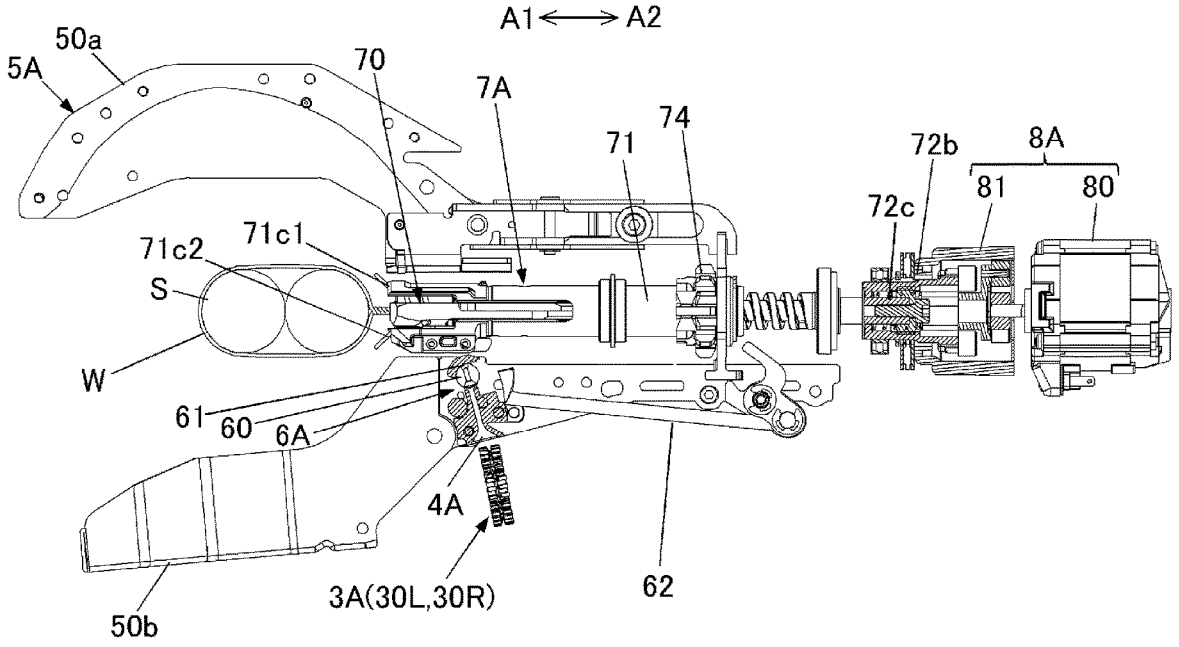
FIG. 5H is a main portion side cross-sectional view illustrating the example of the operation of the reinforcing bar binding machine according to the first embodiment.

Operation Example of Reinforcing Bar Binding Machine According to First Embodiment FIGS. 5A, 5B, 5C, 5D, 5E, 5F, 5G, and 5H are main portion side cross-sectional views illustrating an example of an operation of the reinforcing bar binding machine according to the first embodiment. FIG. 5A illustrates a state in which the reinforcing bars S are inserted at a position where the reinforcing bars S can be bound. FIG. 5B illustrates an operation of feeding the wires W in the forward direction and winding the wires W around the reinforcing bars S. FIG. 5C illustrates an operation of locking the wires W wound around the reinforcing bars S. FIG. 5D illustrates an operation of feeding the wires W in the reverse direction and winding the wires W around the reinforcing bars S. FIG. 5E illustrates an operation of cutting a surplus of the wires W wound around the reinforcing bars S. FIG. 5F illustrates an operation of bending the wires W wound around the reinforcing bars S. FIGS. 5G and 5H illustrate an operation of twisting the wires W wound around the reinforcing bars S.

Next, an operation of binding the reinforcing bars S with the wires W by the reinforcing bar binding machine 1A according to the first embodiment will be described with reference to FIGS. 5A, 5B, 5C, 5D, 5E, 5F, 5G, and 5H.

In the reinforcing bar binding machine 1A, a state in which the two wires W are sandwiched between the pair of feeding gears 30 (30L and 30R) and the distal ends of the two wires W are positioned between a sandwich position of the feeding gears 30 (30L and 30R) and the fixed blade portion 60 of the cutting portion 6A is a standby state. Further, in the reinforcing bar binding machine 1A, in the standby state, the sleeve 71 and the wire locking body 70 having the first side hook 70R, the second side hook 70L, and the center hook 70C attached to the sleeve 71 move to the rearward side indicated by the arrow A2, and as illustrated in FIG. 4A, the first side hook 70R is opened with respect to the center hook 70C, and the second side hook 70L is opened with respect to the center hook 70C.

As illustrated in FIG. 5A, when the reinforcing bars S are inserted between the curling guide 50*a* and the leading guide 50*b* of the curl forming portion 5A and the trigger 12A is operated, the feeding motor 31 is driven in a forward rotation direction, and as illustrated in FIG. 5B, the two wires W are fed in the forward direction indicated by the arrow F by the wire feeding portion 3A.

The two wires W fed in the forward direction by the wire feeding portion 3A are arranged in parallel along the axial direction of the annular feeding path Ru by the wire guide 4A.

The two wires W fed in the forward direction pass between the center hook 70C and the first side hook 70R and are fed to the curling guide 50*a* of the curl forming portion 5A. By passing through the curling guide 50*a*, the two wires W are curled to be wound around the reinforcing bars S along the annular feeding path Ru.

The two wires W, which are fed in the forward direction by the wire feeding portion 3A and are curled by the curling guide 50*a* along the annular feeding path Ru, are led by the leading guide 50*b*, and further are fed in the forward direction by the wire feeding portion 3A, whereby the wires are led between the center hook 70C and the second side hook 70L by the leading guide 50*b*. Then, the two wires W are fed until the distal ends of the two wires W abut against the wire abutting portion 90. When the distal ends of the two wires W are fed to a position at which the distal ends abut against the wire abutting portion 90, the driving of the feeding motor 31 is stopped.

After the feeding of the wires W in the forward direction is stopped, the motor 80 is driven in the forward rotation direction. Regarding the sleeve 71, in an operation range in which the wires W are locked by the wire locking body 70, the rotation of the sleeve 71 in conjunction with the rotation of the rotation shaft 72 is regulated by the rotation regulating portion 74. Accordingly, as illustrated in FIG. 5C, the rotation of the motor 80 is converted into a linear movement, and the sleeve 71 moves in the direction indicated by the arrow A1 which is the forward side.

When the sleeve 71 is moved to the forward side, the opening and closing pin 71*a* passes through the opening and closing guide hole 73. Accordingly, the first side hook 70R is moved in the direction in which the first side hook 70R approaches the center hook 70C by the rotation operation with the shaft 71*b* as a fulcrum. When the first side hook 70R is closed with respect to the center hook 70C, the wires W sandwiched between the first side hook 70R and the center hook 70C are locked in a manner of being capable of moving between the first side hook 70R and the center hook 70C.

The second side hook 70L is moved in the direction in which the second side hook 70L approaches the center hook 70C by the rotation operation with the shaft 71*b* as a fulcrum. When the second side hook 70L is closed with respect to the center hook 70C, the wires W sandwiched between the second side hook 70L and the center hook 70C are locked in a manner that the wires W are not removed from the portion between the second side hook 70L and the center hook 70C.

After the sleeve 71 is advanced to a position at which the wires W are locked by the operation of closing the first side hook 70R and the second side hook 70L, the rotation of the motor 80 is temporarily stopped, and the feeding motor 31 is driven in a reverse rotation direction.

Accordingly, the pair of feeding gears 30 (30L and 30R) rotate in reverse, and as illustrated in FIG. 5D, the two wires W sandwiched between the pair of feeding gears 30 (30L and 30R) are fed in the reverse direction indicated by the arrow R. The distal end side of the two wires W are locked so as not to be removed from the portion between the second side hook 70L and the center hook 70C, and thus the wires W are wound around the reinforcing bars S by the operation of feeding the wires W in the reverse direction.

After winding the wires W around the reinforcing bars S and stopping the driving of the feeding motor 31 in the reverse rotation direction, the sleeve 71 is further moved to the forward side indicated by the arrow A1 by driving the motor 80 in the forward rotation direction. As illustrated in FIG. 5E, when the movement of the sleeve 71 to the forward side is transmitted to the cutting portion 6A by the transmission mechanism 62, the movable blade portion 61 rotates, and the wires W locked by the first side hook 70R and the center hook 70C are cut by operations of the fixed blade portion 60 and the movable blade portion 61.

When the motor 80 is driven in the forward rotation direction, the sleeve 71 is moved to the forward side indicated by the arrow A1, the two wires W are cut, and the bending portions 71*c*1 and 71*c*2 move in a direction approaching the reinforcing bars S almost at the same time. Accordingly, the distal end side of the two wires W locked by the center hook 70C and the first side hook 70R is pressed toward the reinforcing bars S by the bending portion 71*c*1, and is bent toward the reinforcing bars S with a locking position as a fulcrum. When the sleeve 71 is further moved to the forward side, the wires W locked between the second side hook 70L and the center hook 70C are held in a state of being sandwiched by the bending portion 71*c*1.

The terminal end side of the wires W locked by the center hook 70C and the first side hook 70R and cut by the cutting portion 6A is pressed toward the reinforcing bars S by the bending portion 71*c*2, and is bent toward the reinforcing bars S side with the locking position as a fulcrum. When the sleeve 71 is further moved to the forward side, the wires W locked between the first side hook 70R and the center hook are held in a state of being sandwiched by the bending portion 71*c*2. In an operation range in which the wires W are bent and formed, the sleeve 71 is regulated from rotating in conjunction with the rotation of the rotation shaft 72 by the rotation regulating portion 74, and the sleeve 71 is moved to the forward side without rotating.

After the distal end side and the terminal end side of each of the two wires W are bent toward the reinforcing bars S, the motor 80 is further driven in the forward rotation direction, and the sleeve 71 is further moved to the forward side. When the sleeve 71 moves to a predetermined position, the regulation of the rotation of the sleeve 71 by the rotation regulating portion 74 is released.

Accordingly, when the motor 80 is further driven in the forward rotation direction, the sleeve 71 rotates in conjunction with the rotation shaft 72, and as illustrated in FIG. 5F, the operation of twisting the two wires W locked by the wire locking body 70 is started.

In the binding portion 7A, in an operation range in which the sleeve 71 rotates to twist the wires W, the wires W locked by the wire locking body 70 are twisted, whereby a force that pulls the wire locking body 70 to the forward side along the axial direction of the rotation shaft 72 is applied. On the other hand, the rotation shaft 72 receives a force that is pressed to the rearward side by the spring 72*c*. Accordingly, the wire locking body 70 moves to the forward side while the rotation shaft 72 receives the force that is pressed to the rearward side by the spring 72*c*, and as illustrated in FIG. 5G, the wires W are twisted while the wire locking body 70 moves to the forward side.

In the binding portion 7A, in the operation range in which the sleeve 71 rotates to twist the wires W, when the wire locking body 70 further rotates in conjunction with the rotation shaft 72, the wire locking body 70 and the rotation shaft 72 further twist the wires W while moving to the forward side which is a direction in which a gap between a twisted portion of the wires W and the reinforcing bars S decreases.

Therefore, as illustrated in FIG. 5H, the gap between the twisted portion of the wires W and the reinforcing bars S decreases, and the twisted two wires W are brought into close contact with the reinforcing bars S along the reinforcing bars S.

When it is detected that a load applied to the motor 80 is maximized by twisting the two wires W, the forward rotation of the motor 80 is stopped. Next, when the motor 80 is driven in the reverse rotation direction, the rotation shaft 72 rotates in reverse, and the sleeve 71 rotates in reverse following the reverse rotation of the rotation shaft 72, the sleeve 71 is regulated from rotating in conjunction with the rotation of the rotation shaft 72 by the rotation regulating portion 74. Accordingly, the sleeve 71 moves in the direction indicated by the arrow A2 which is the rearward side.

When the sleeve 71 moves to the rearward side, the bending portions 71*c*1 and 71*c*2 are separated from the wires W, and the holding of the wires W by the bending portions 71*c*1 and 71*c*2 is released. Further, when the sleeve 71 moves to the rearward side, the opening and closing pin 71*a* passes through the opening and closing guide hole 73. Accordingly, the first side hook 70R is moved in a direction away from the center hook 70C by the rotation operation with the shaft 71*b* as a fulcrum. The second side hook 70L is moved in the direction away from the center hook 70C by the rotation operation with the shaft 71*b* as a fulcrum. Accordingly, the two wires W binding the reinforcing bars S are removed from the wire locking body 70.

Function and Effect Example of Reinforcing Bar Binding Machine According to First Embodiment The magazine 2A is not provided with a driving unit that rotates the reel 20, and thus the reel 20 rotates following the feeding of the wires W by the operation of feeding the wires W in the forward direction indicated by the arrow F. On the other hand, when the feeding of the wires W in the forward direction is stopped, the reel 20 continues to rotate slightly due to inertia, and thus the wires W wound around the reel 20 are loosened and spread in the radial direction of the reel 20.

In addition, the reel 20 rotates in a state of being pressed by the wires W by the operation of feeding the wires W in the reverse direction indicated by the arrow R, but the rotation of the reel 20 is delayed with respect to a feeding speed of the wires W by the wire feeding portion 3A. Accordingly, the wires W are bent in a direction in which the wires W spread along the radial direction of the reel 20 by the operation of feeding the wires W in the reverse direction indicated by the arrow R.

Therefore, in a configuration in which the separating portion 23 is not provided in the feeding path forming portion 21*d* where the wires W are easily bent, a force of winding the bent wires W around the reel 20 is applied by the next operation of feeding the wires W in the forward direction indicated by the arrow F, and there is a possibility that the bent wires W are entangled with the wires W wound around the reel 20.

On the other hand, the separating portion 23 is provided in the feeding path forming portion 21*d*, and thus the reel 20 accommodated in the magazine 2A and the wires W bent by the feeding path forming portion 21*d* are separated by the separating portion 23 in a range in which the bent wires W easily approach the reel 20 by the operation of feeding the wires W in the forward direction indicated by the arrow F.

Accordingly, the wires W that are fed in the reverse direction indicated by the arrow R and are bent are restrained from being displaced in a direction approaching the reel 20 by the next operation of feeding the wires W in the forward direction indicated by the arrow F, and the wires W pulled out from the reel 20 is restrained from being entangled with the wires W wound around the reel 20.

In addition, since the separating portion 23 includes the rotating members 24*a* and 24*b* at the end portions on the upstream side and the downstream side in the feeding direction of the wires W, the wires W mainly fed in the forward direction come into contact with the rotating members 24*a* and 24*b*, and the rotating members 24*a* and 24*b* rotate. Accordingly, a sliding resistance is reduced when the wires W slide against the separating portion 23.

The wires W wound around the reel 20 are pulled out while moving along the axial direction of the reel 20 by the operation of feeding the wires W in the forward direction indicated by the arrow F. However, the wires W pulled out from the reel 20 may be located close to the second direction indicated by the arrow C2 inside the magazine 2A, and the second direction is a direction opposite to the first direction in which the reel 20 is offset. In such a case, the wires W fed in the forward direction by the wire feeding portion 3A and curled by the curling guide 50*a* may be led in the first direction from the curling guide 50*a* and may be detached from the leading guide 50*b*. In particular, in the configuration in which the two wires W are fed, the above situation remarkably occurs in the wires W in contact with the feeding gear 30L on the driving side.

Therefore, the magazine 2A includes the regulating portion 25 that regulates the movement of the wires W toward the second direction indicated by the arrow C2 in the feeding path forming portion 21*d*. Since the regulating portion 25 is constituted by the protrusion protruding in the first direction indicated by the arrow C1 from the side wall portion 21*a*, the wires W passing through the outside of the separating portion 23 are restrained from moving in the second direction beyond the regulating portion 25. Accordingly, the wires W pulled out from the reel 20 are restrained from being located close to the second direction inside the magazine 2A.

Therefore, in the magazine 2A, a position of the wires W along the axial direction of the annular feeding path Ru and the axial direction of the reel 20 is stabilized without being biased in the second direction. Accordingly, the wires W fed in the forward direction by the wire feeding portion 3A and curled by the curling guide 50*a* can be restrained from being led in the first direction from the curling guide 50*a*, and can be led to enter the leading guide 50*b*. Accordingly, it is not necessary to increase the size of the leading guide 50*b*, it is possible to restrain an increase in size and an increase in weight of the reinforcing bar binding machine 1A, and it is possible to restrain deterioration of operability.

Modifications of Reinforcing Bar Binding Machine According to the Present Embodiment

Other Configuration Examples of Magazine

Figure 6A:
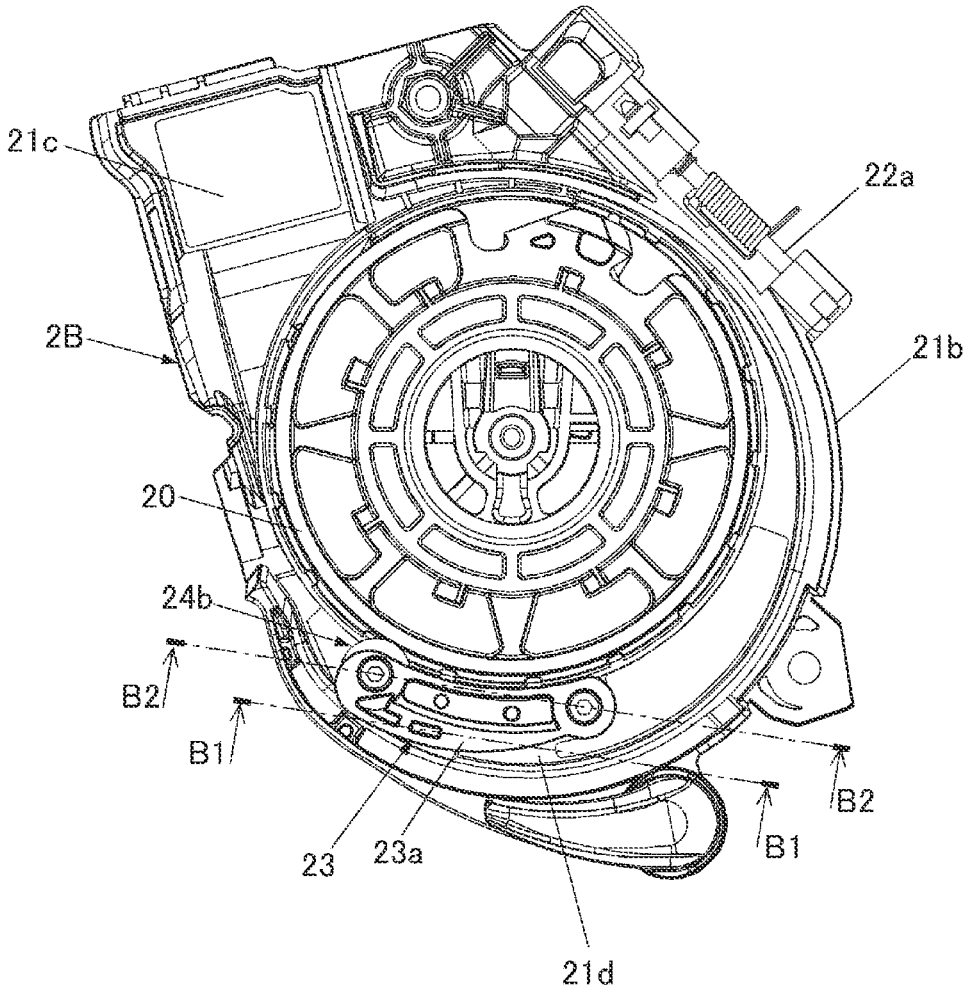
FIG. 6A is a side view illustrating an example of a magazine according to a second embodiment.
Figure 6B:
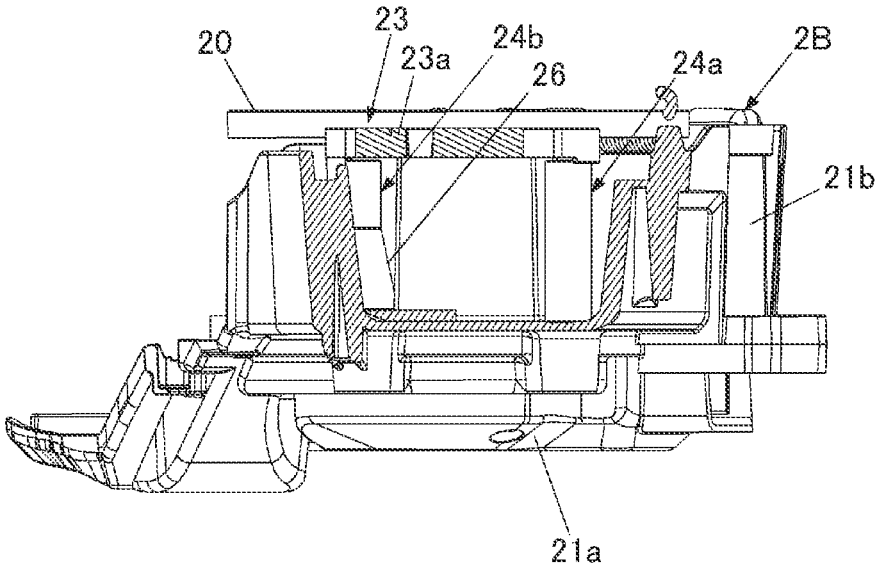
FIG. 6B is a cross-sectional view taken along a line B1-B1 of FIG. 6A.
Figure 6C:
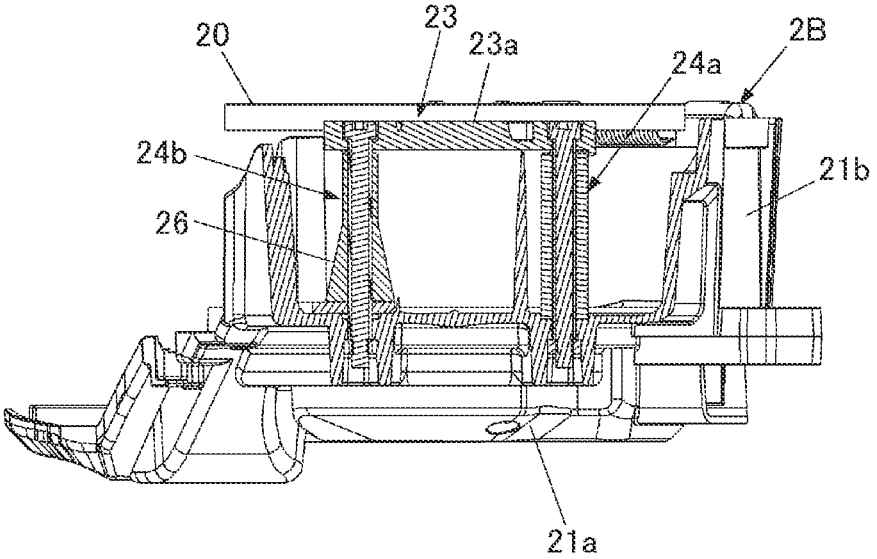
FIG. 6C is a cross-sectional view taken along a line B2-B2 of FIG. 6A.
Figure 6D:
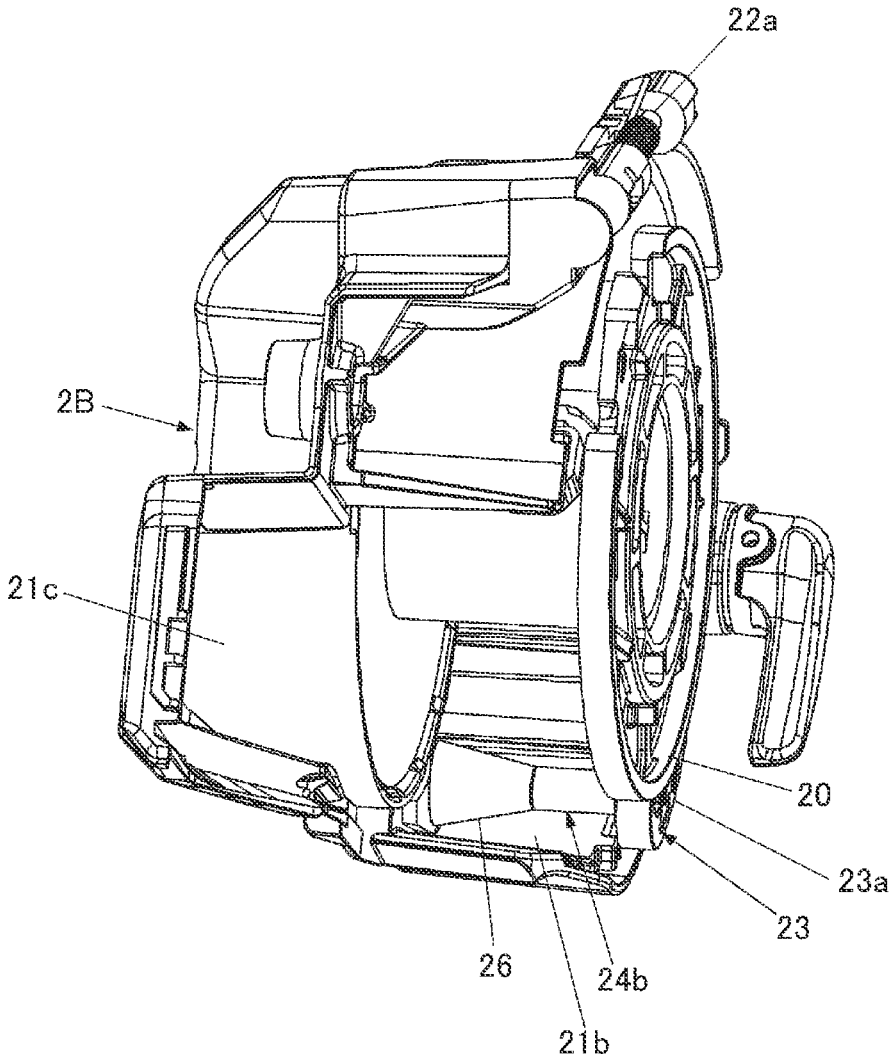
FIG. 6D is a perspective view illustrating the example of the magazine according to the second embodiment.
Figure 7A:
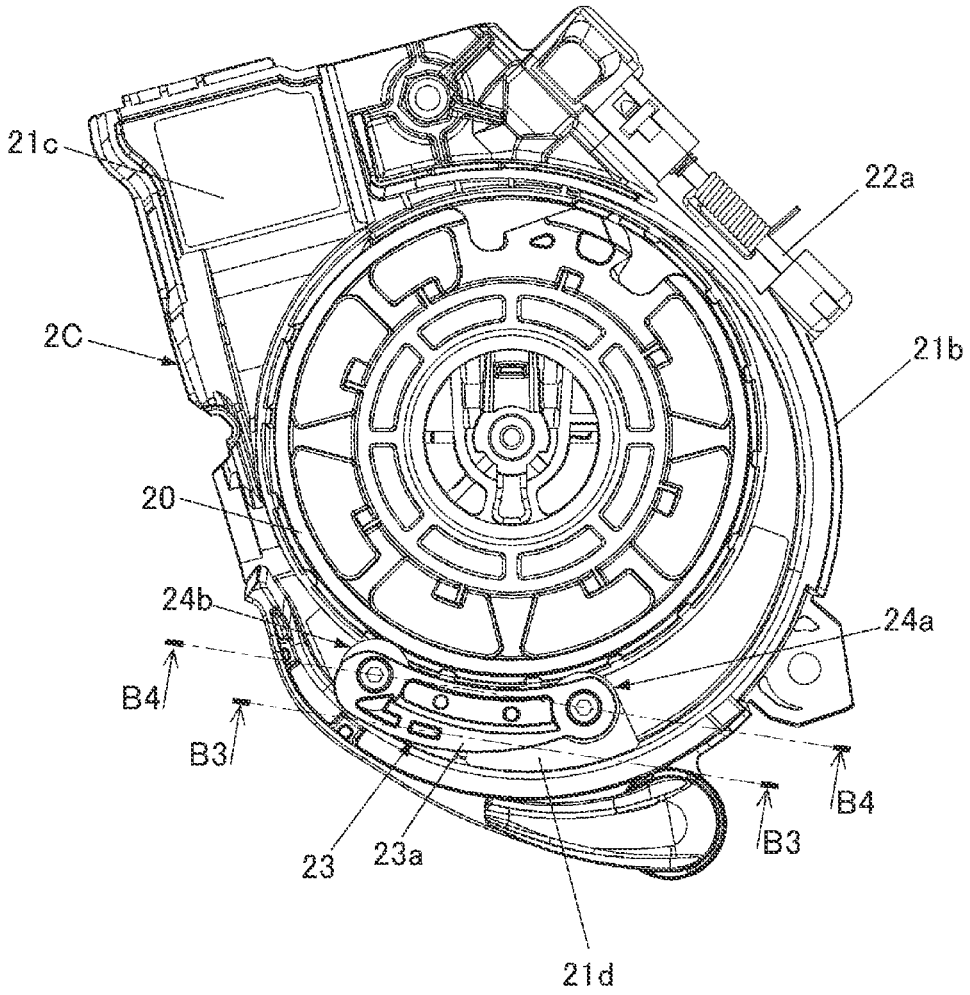
FIG. 7A is a side view illustrating another example of the magazine according to the second embodiment.
Figure 7B:
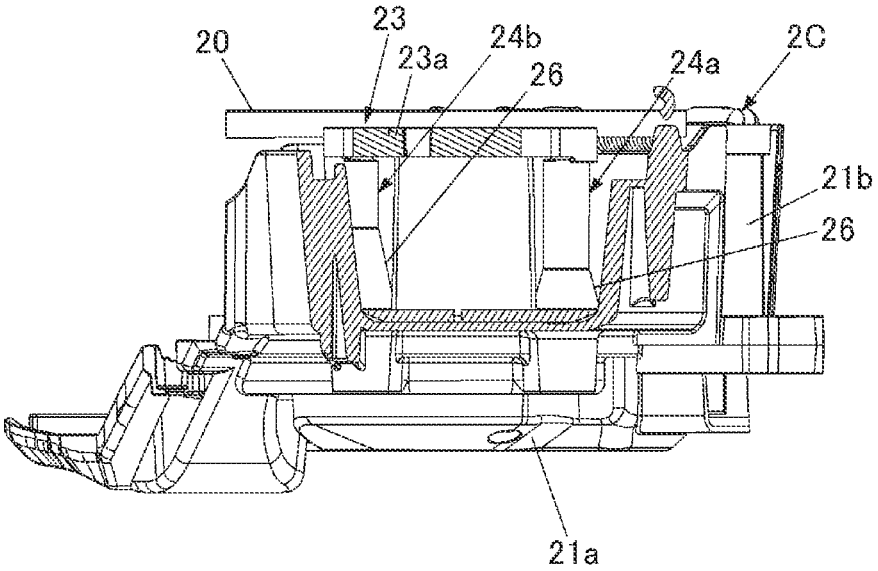
FIG. 7B is a cross-sectional view taken along a line B3-B3 of FIG. 7A.
Figure 7C:
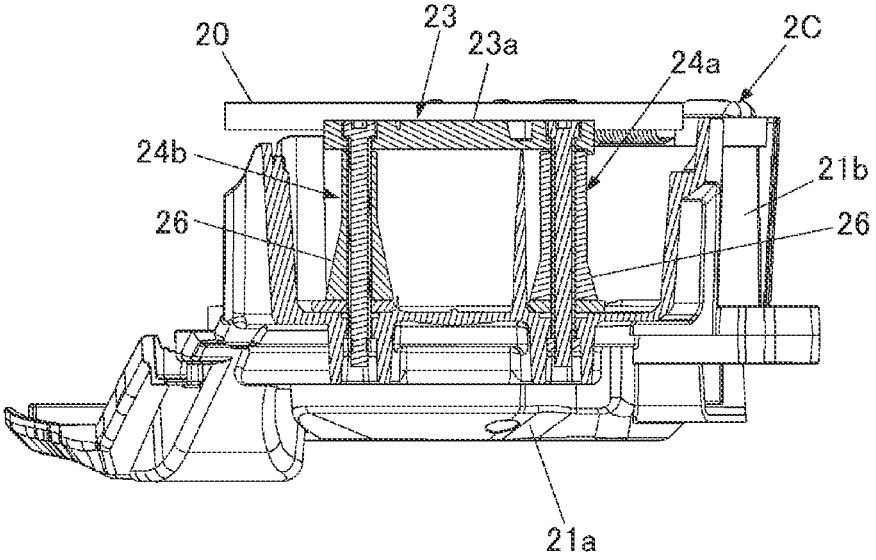
FIG. 7C is a cross-sectional view taken along a line B4-B4 of FIG. 7A.

FIG. 6A is a side view illustrating an example of a magazine according to a second embodiment, FIG. 6B is a cross-sectional view taken along a line B1-B1 of FIG. 6A, FIG. 6C is a cross-sectional view taken along a line B2-B2 of FIG. 6A, and FIG. 6D is a perspective view illustrating the example of the magazine according to the second embodiment. Further, FIG. 7A is a side view illustrating another example of the magazine according to the second embodiment, FIG. 7B is a cross-sectional view taken along a line B3-B3 of FIG. 7A, and FIG. 7C is a cross-sectional view taken along a line B4-B4 of FIG. 7A. In addition, FIGS. 8A, 8B, 8C and 8D are perspective views illustrating an example of a rotating member of the magazine according to the second embodiment.

In magazines 2B and 2C according to the second embodiment, configurations similar to those of the magazine 2A according to the first embodiment are denoted by the same reference numerals. The magazine 2B includes the separating portion 23 in the feeding path forming portion 21*d*. The separating portion 23 separates the reel 20 accommodated in the magazine 2B and the wires W bent by the feeding path forming portion 21*d*.

The separating portion 23 includes the rotating member 24*a* on the upstream side in the feeding direction of the wires W indicated by the arrow F, and includes the rotating member 24*b* on the downstream side in the feeding direction of the wires W indicated by the arrow F. The rotating members 24*a* and 24*b* are rotatably provided such that the rotation axes thereof extend in the direction intersecting the feeding direction of the wires W, and the wires W fed in the forward direction or the reverse direction come into contact with the rotation axes.

The magazine 2B includes a regulating portion 26 in the rotating member 24*b*. The regulating portion 26 is constituted by an inclined surface where the outer peripheral surface of the rotating member 24*b* is inclined in a direction in which a diameter of the rotating member 24*b* decreases from an end portion of the rotating member 24*b* in the second direction indicated by the arrow C2 toward the first direction indicated by the arrow C1 in which the reel 20 is offset, and the second direction is opposite to the direction in which the reel 20 is offset.

The regulating portion 26 has a conical shape inclined in a direction in which the wires W in contact with the rotating member 24*b* are led in the first direction along the axial direction of the rotating member 24*b*. Accordingly, when the wires W mainly fed in the forward direction come into contact with the regulating portion 26 of the rotating member 24*b*, the wires W are fed while being led in the first direction indicated by the arrow C1 due to the conical shape of the regulating portion 26, and the wires W are regulated from moving in the second direction indicated by the arrow C2 in the feeding path forming portion 21*d*.

The magazine 2C includes the regulating portion 26 in the rotating member 24*a* and the rotating member 24*b*. The regulating portion 26 is constituted by an inclined surface where the outer peripheral surfaces of the rotating members 24*a* and 24*b* are inclined in a direction in which the diameters of the rotating members 24*a* and 24*b* decrease from the end portions of the rotating members 24*a* and 24*b* in the second direction indicated by the arrow C2 toward the first direction indicated by the arrow C1 in which the reel 20 is offset, and the second direction is opposite to the direction in which the reel 20 is offset.

The regulating portion 26 has a conical shape inclined in a direction in which the wires W in contact with the rotating members 24*a* and 24*b* are led in the first direction along the axial directions of the rotating members 24*a* and 24*b*. Accordingly, when the wires W mainly fed in the forward direction come into contact with the regulating portion 26 of the rotating members 24*a* and 24*b*, the wires W are fed while being led in the first direction indicated by the arrow C1 due to the conical shape of the regulating portion 26, and the wires W are regulated from moving in the second direction indicated by the arrow C2 in the feeding path forming portion 21*d*.

Figure 8A:
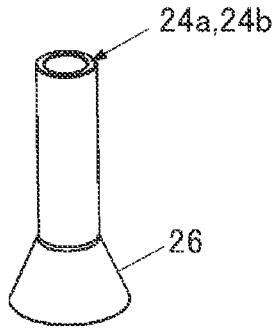
FIG. 8A is a perspective view illustrating an example of a rotating member of the magazine according to the second embodiment.
Figure 8B:
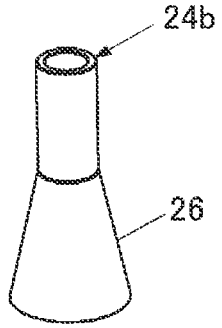
FIG. 8B is a perspective view illustrating the example of the rotating member of the magazine according to the second embodiment.
Figure 8C:
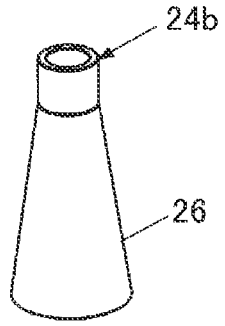
FIG. 8C is a perspective view illustrating the example of the rotating member of the magazine according to the second embodiment.
Figure 8D:
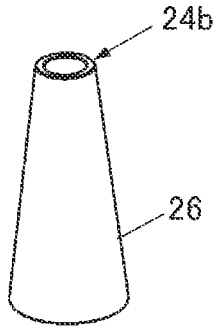
FIG. 8D is a perspective view illustrating the example of the rotating member of the magazine according to the second embodiment.

In a configuration in which the regulating portion 26 is provided in the rotating member 24*b*, as illustrated in FIG. 8A, the regulating portion 26 may be provided in a range of about ⅓ of a length of the rotating member 24*b* in the axial direction, which is shorter than half of the length, from the end portion of the rotating member 24*b* in the second direction indicated by the arrow C2 to form the conical shape, and a remaining portion of the rotating member 24*b* may be formed in a cylindrical shape. Further, as illustrated in FIG. 8B, the regulating portion 26 may be provided in a range of about half the length of the rotating member 24*b* in the axial direction from the end portion of the rotating member 24*b* in the second direction indicated by the arrow C2 to form the conical shape, and a remaining portion of the rotating member 24*b* may be formed in a cylindrical shape. In addition, as illustrated in FIG. 8C, the regulating portion 26 may be provided in a range of about ⅔ of the length of the rotating member 24*b* in the axial direction, which is longer than half of the length, from the end portion of the rotating member 24*b* in the second direction indicated by the arrow C2 to form the conical shape, and a remaining portion of the rotating member 24*b* may be formed in a cylindrical shape. Further, as illustrated in FIG. 8D, the regulating portion 26 may be provided over the entire rotating member 24*b* along the axial direction to form the conical shape.

On the other hand, in a configuration in which the regulating portion 26 is provided in the rotating member 24*a*, as illustrated in FIG. 8A, it is preferable that the regulating portion 26 is provided in a range of about ⅓ of a length of the rotating member 24*a* in the axial direction, which is shorter than half of the length, from the end portion of the rotating member 24*a* in the second direction indicated by the arrow C2 to form the conical shape, and a remaining portion of the rotating member 24*a* is formed in a cylindrical shape. A diameter of the portion of the rotating member 24*a* having the cylindrical shape is larger than that of the rotating member 24*b*. When the diameter of the rotating member 24*a* is small, a curvature is reduced when the wires W come into contact with the outer peripheral surface and the path of the wires W is changed as compared with a case where the diameter of the rotating member 24*a* is large, and thus the wires W may be bent. Therefore, the diameter of the rotating member 24*a* is increased. On the other hand, when the regulating portion 26 is provided over the entire rotating member 24*a* along the axial direction to form the conical shape, it is necessary to increase a diameter of a small diameter side of the conical shape. However, a diameter of a large diameter side of the conical shape is limited to be increased due to a limitation by the size of the magazine 2C or the like. Therefore, an angle of a taper is decreased, and an effect of moving the wires W on the inclined surface of the outer peripheral surface of the rotating member 24*a* is reduced. Therefore, it is preferable that the rotating member 24*a* has a configuration in which the regulating portion 26 is provided in the range of about ⅓ of the length in the axial direction to form the conical shape, and the remaining portion is formed in the cylindrical shape.

The magazine 2B may not include the rotating member 24*a* but include the rotating member 24*b*, and may include the regulating portion 26 in the rotating member 24*b*. Further, the magazine 2C may not include the rotating member 24*a* but include the rotating member 24*b*, and may include the regulating portion 26 in the rotating member 24*b*. Even in a configuration in which the reinforcing bars S are bound by using a single wire W, the offset of the magazines 2A, 2B and 2C (the reel 20) causes a matter that the wires W move toward the second direction indicated by the arrow C2. Then, by including the regulating portions 25 and 26, it is possible to regulate the wires W from moving in the second direction indicated by the arrow C2 in the feeding path forming portion 21*d*. Accordingly, in the embodiments described above, examples of binding the reinforcing bars S by using a plurality of wires W are described, but a configuration in which the reinforcing bars S are bound by using a single wire W may be adopted, and the number of wires W is not essential.

Figure 9A:
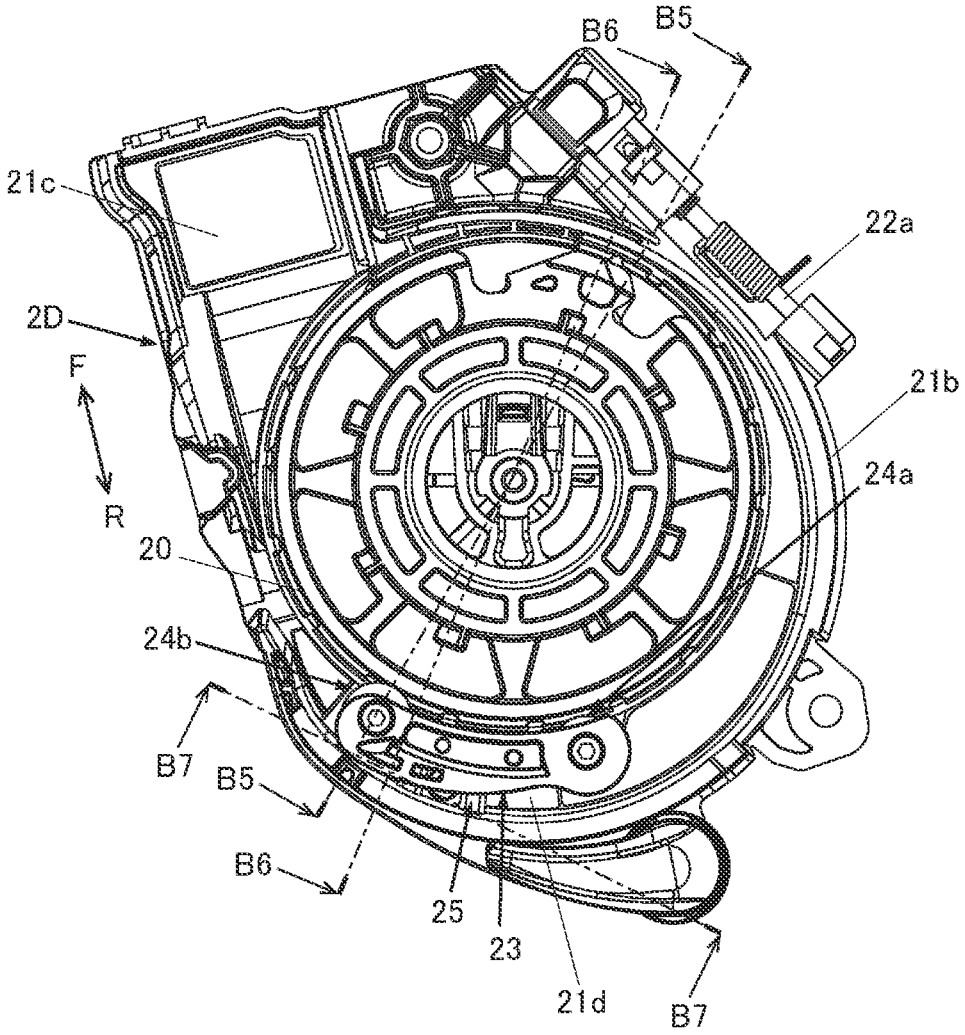
FIG. 9A is a side view illustrating an example of a magazine according to a third embodiment.
Figure 9B:
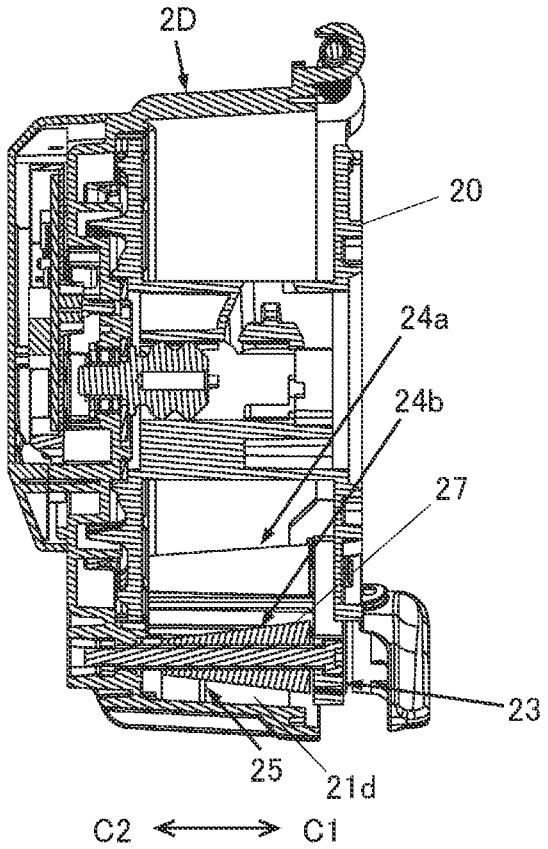
FIG. 9B is a cross-sectional view taken along a line B5-B5 of FIG. 9A.
Figure 9C:
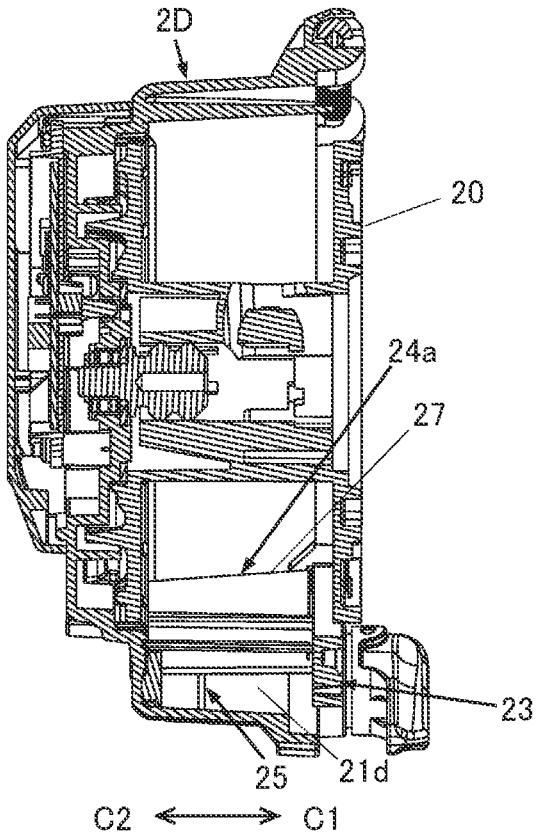
FIG. 9C is a cross-sectional view taken along a line B6-B6 of FIG. 9A.
Figure 9D:
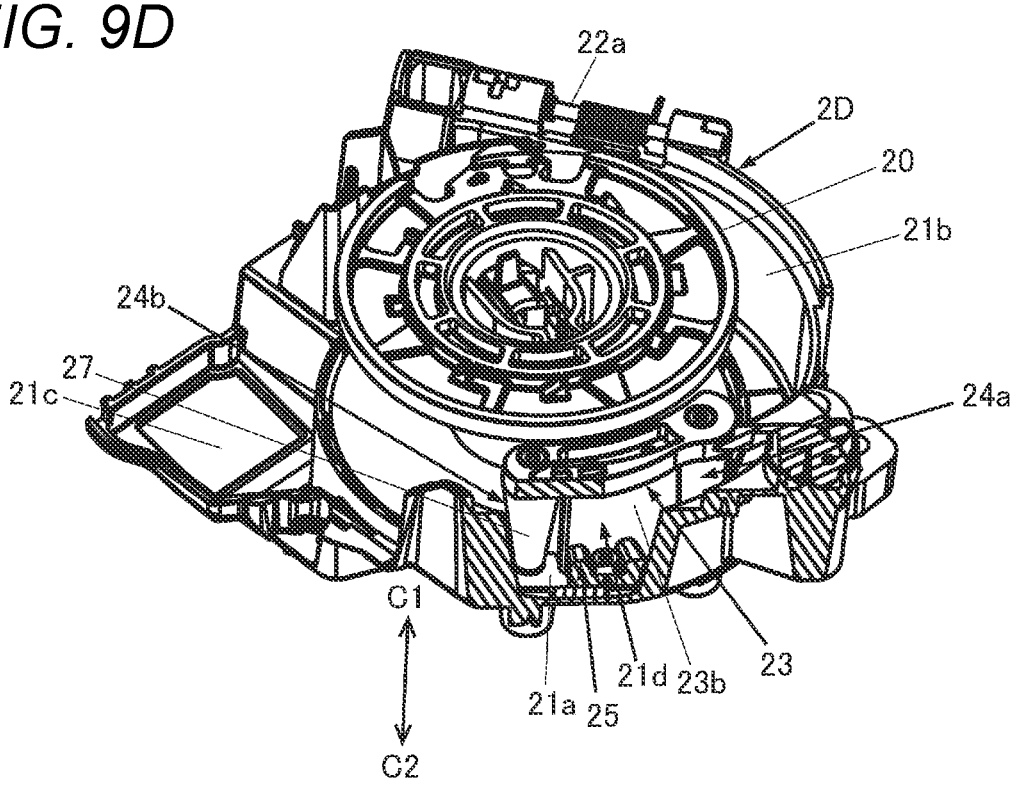
FIG. 9D is a cross-sectional perspective view taken along a line B7-B7 of FIG. 9A.
Figure 9E:
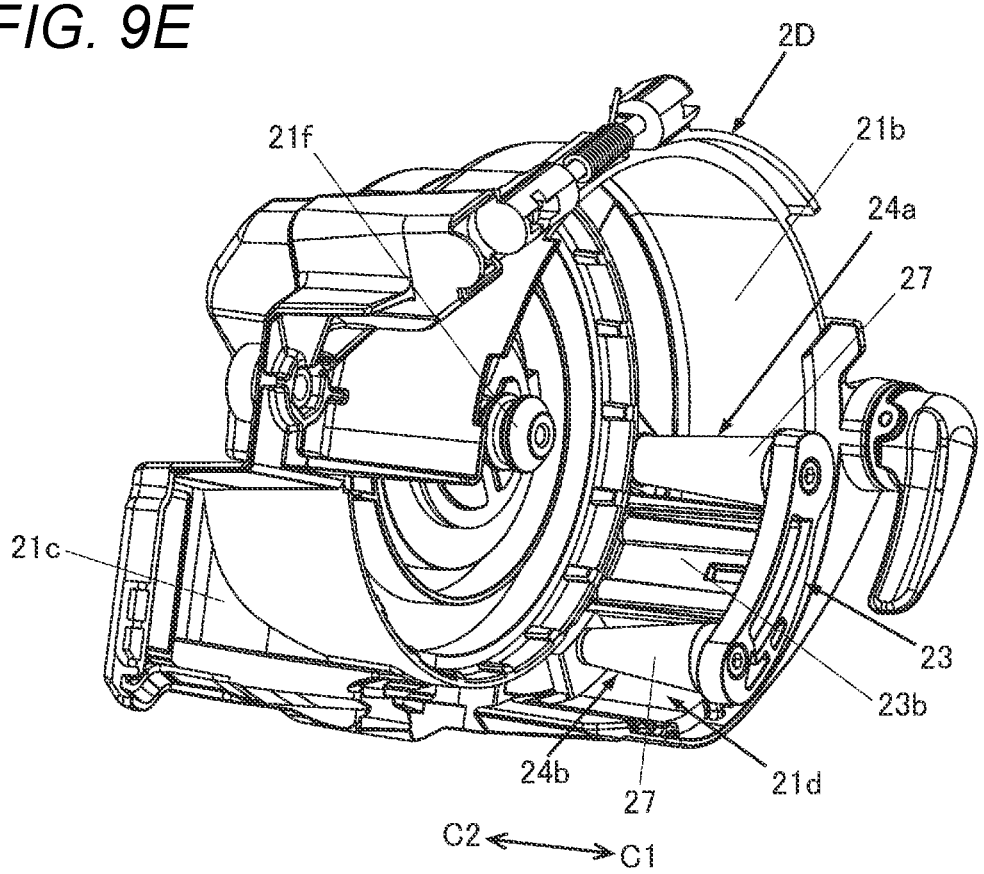
FIG. 9E is a perspective view illustrating the example of the magazine according to the third embodiment.

FIG. 9A is a side view illustrating an example of a magazine according to a third embodiment, FIG. 9B is a cross-sectional view taken along a line B5-B5 of FIG. 9A, FIG. 9C is a cross-sectional view taken along a line B6-B6 of FIG. 9A, FIG. 9D is a cross-sectional perspective view taken along a line B7-B7 of FIG. 9A, and FIG. 9E is a perspective view illustrating the example of the magazine according to the third embodiment.

In a magazine 2D according to the third embodiment, configurations similar to those of the magazine 2A according to the first embodiment are denoted by the same reference numerals. The magazine 2D includes the separating portion 23 in the feeding path forming portion 21*d*. The separating portion 23 separates the reel 20 accommodated in the magazine 2D and the wires W bent by the feeding path forming portion 21*d*. The separating portion 23 includes the protruding portion 23*b* protruding in the first direction indicated by the arrow C1 from the side wall portion 21*a* toward the feeding path forming portion 21*d* of the magazine 2D. The protruding portion 23*b* protrudes in the axial direction of the reel 20 along the peripheral wall portion 21*b*.

The separating portion 23 includes the rotating member 24*b* in the feeding path forming portion 21*d* of the magazine 2D. The separating portion 23 may not include the protruding portion 23*b* but include the rotating member 24*b*. In a configuration in which the separating portion 23 includes the protruding portion 23*b*, the rotating member 24*b* is provided on the downstream side in the feeding direction of the wires W indicated by the arrow F with respect to the protruding portion 23*b*. The separating portion 23 may further include the rotating member 24*a* in the feeding path forming portion 21*d* of the magazine 2D. In a configuration in which the separating portion 23 does not include the protruding portion 23*b*, the rotating member 24*a* is provided on the upstream side in the feeding direction of the wires W indicated by the arrow F with respect to the rotating member 24*b*. In the configuration in which the separating portion 23 includes the protruding portion 23*b*, the rotating member 24*a* is provided on the upstream side in the feeding direction of the wires W indicated by the arrow F with respect to the protruding portion 23*b*. The rotating members 24*a* and 24*b* are rotatably provided such that the rotation axes thereof extend in the direction intersecting the feeding direction of the wires W, and the wires W fed in the forward direction or the reverse direction come into contact with the rotation axes.

The magazine 2D includes a regulating portion 27 in the rotating member 24*b*. In a configuration in which the rotating member 24*a* is provided, the magazine 2D may also include the regulating portion 27 in the rotating member 24*a*. The regulating portion 27 in the rotating member 24*b* is constituted by an inclined surface where the outer peripheral surface of the rotating member 24*b* is inclined in a direction in which the diameter of the rotating member 24*b* decreases from an end portion of the rotating member 24*b* in the first direction indicated by the arrow C1 in which the reel 20 is offset, toward the second direction indicated by the arrow C2, and the second direction is opposite to the direction in which the reel 20 is offset. In a configuration in which the rotating member 24*a* is further provided and the regulating portion 27 is provided in the rotating member 24*a*, similarly, the regulating portion 27 in the rotating member 24*a* is constituted by an inclined surface where the outer peripheral surface of the rotating member 24*a* is inclined in a direction in which the diameter of the rotating member 24*a* decreases from an end portion of the rotating member 24*a* in the first direction indicated by the arrow C1 in which the reel 20 is offset, toward the second direction indicated by the arrow C2, and the second direction is opposite to the direction in which the reel 20 is offset. In the configuration in which the rotating member 24*a* is further provided and the regulating portion 27 is provided in the rotating member 24*a*, inclined angles of the regulating portion 27 with respect to the axial directions of the rotating member 24*a* and the rotating member 24*b* may be the same or may be different. For example, the inclined angle of the regulating portion 27 with respect to the rotating member 24*b* may be larger than the inclined angle of the regulating portion 27 with respect to the rotating member 24*a*.

The magazine 2D may include the regulating portion 25 that regulates the movement of the wires W in the second direction indicated by the arrow C2 along the axial direction of the reel 20. The regulating portion 25 is constituted by a protrusion protruding in the first direction indicated by the arrow C1 with respect to the side wall portion 21*a*. The regulating portion 25 may be fixed to the side wall portion 21*a* by using a screw or the like, and may be provided integrally with the side wall portion 21*a*. Further, the regulating portion 25 may be fixed to the peripheral wall portion 21*b* facing the feeding path forming portion 21*d* by using a screw or the like, and may be provided integrally with the peripheral wall portion 21*b*.

The regulating portion 25 is provided on the upstream side in the feeding direction of the wires W indicated by the arrow F with respect to the rotating member 24*b*. The regulating portion 25 may be provided on the downstream side in the feeding direction of the wires W indicated by the arrow F with respect to the rotating member 24*b*. In addition, the regulating portion 25 may be provided on the upstream side and the downstream side in the feeding direction of the wires W indicated by the arrow F with respect to the rotating member 24*b*. In a configuration in which the rotating member 24*b* and further the rotating member 24*a* are provided, the regulating portion 25 is provided between the rotating member 24*a* and the rotating member 24*b*. In the configuration in which the separating portion 23 includes the protruding portion 23*b*, the regulating portion 25 is provided on the outer side along the radial direction of the reel 20 with respect to the protruding portion 23*b*. In the configuration in which the rotating member 24*b* and further the rotating member 24*a* are provided, the regulating portion 25 is configured such that a length along the circumferential direction of the reel 20 is shorter than a length between the rotating member 24*a* and the rotating member 24*b*. In addition, the protrusion height of the regulating portion 25 from the side wall portion 21*a* is about half or less than half of the length of the rotating member 24*a* and/or the rotating member 24*b* in the axial direction. That is, the protrusion height of the regulating portion 25 from the side wall portion 21*a* is about half or less than half of the length of the reel 20 in the axial direction.

The regulating portion 27 has a conical shape inclined in a direction in which the wires W in contact with the rotating member 24*b* are led in the second direction indicated by the arrow C2 along the axial direction of the rotating member 24*b*. Accordingly, when the wires W mainly fed in the forward direction come into contact with the regulating portion 27 of the rotating member 24*b*, the wires W are fed while being led in the second direction indicated by the arrow C2 due to the conical shape of the regulating portion 27, and the wires W are regulated from moving in the first direction indicated by the arrow C1 in the feeding path forming portion 21*d*. In the configuration in which the rotating member 24*a* is further provided and the regulating portion 27 is provided in the rotating member 24*a*, the regulating portion 27 of the rotating member 24*a* also has a conical shape inclined in a direction in which the wires W in contact with the rotating member 24*a* are led in the second direction indicated by the arrow C2 along the axial direction of the rotating member 24*a*. Accordingly, when the wires W mainly fed in the forward direction come into contact with the regulating portion 27 of the rotating member 24*a* and/or the rotating member 24*b*, the wires W are fed while being led in the second direction indicated by the arrow C2 due to the conical shape of the regulating portion 27, and the wires W are regulated from moving in the first direction indicated by the arrow C1 in the feeding path forming portion 21*d*. Therefore, in the magazine 2D, the position of the wires W along the axial direction of the annular feeding path Ru and the axial direction of the reel 20 is stabilized without being biased in the first direction. Accordingly, the wires W fed in the forward direction by the wire feeding portion 3A and curled by the curling guide 50*a* can be led to enter the leading guide 50*b*. Accordingly, even when a diameter of the reinforcing bars to be bound becomes large and the diameter of the annular feeding path of the wires becomes large, it is not necessary to increase a length of the leading guide 50*b* in a direction along the axial direction of the annular feeding path, it is possible to restrain the increase in size and the increase in weight of the reinforcing bar binding machine 1A, and it is possible to restrain the deterioration of operability.

Further, in a configuration in which the regulating portion 25 is provided, since the regulating portion 25 is constituted by the protrusion protruding in the first direction indicated by the arrow C1 from the side wall portion 21*a*, the wires W passing through the outside of the separating portion 23 are restrained from moving in the second direction beyond the regulating portion 25. Accordingly, the wires W pulled out from the reel 20 are restrained from being located close to the second direction inside the magazine 2D.

Therefore, in the magazine 2D, the position of the wires W along the axial direction of the annular feeding path Ru and the axial direction of the reel 20 is stabilized without being biased in the first direction and the second direction. Accordingly, the wires W fed in the forward direction by the wire feeding portion 3A and curled by the curling guide 50*a* can be led to enter the leading guide 50*b*. Accordingly, even when a diameter of the reinforcing bars to be bound becomes large and the diameter of the annular feeding path of the wires becomes large, it is not necessary to increase a length of the leading guide 50*b* in a direction along the axial direction of the annular feeding path, it is possible to restrain the increase in size and the increase in weight of the reinforcing bar binding machine 1A, and it is possible to restrain the deterioration of operability. The regulating portion 27 is provided in the rotating member 24*b* and/or the rotating member 24*a*, but a non-rotating member may be integrally or separately provided in the feeding path forming portion 21*d* of the magazine 2D, and a regulating portion may be provided in the non-rotating member. For example, such a regulating portion is constituted by an inclined surface inclined in a direction in which an interval between a surface of the member provided in the feeding path forming portion 21*d*, which faces the feeding path forming portion 21*d*, and the peripheral wall portion 21*b* facing the feeding path forming portion 21*d* becomes narrower from the second direction toward the first direction in which the reel 20 is offset, and the second direction is opposite to the direction in which the reel 20 is offset.

Figure 10A:
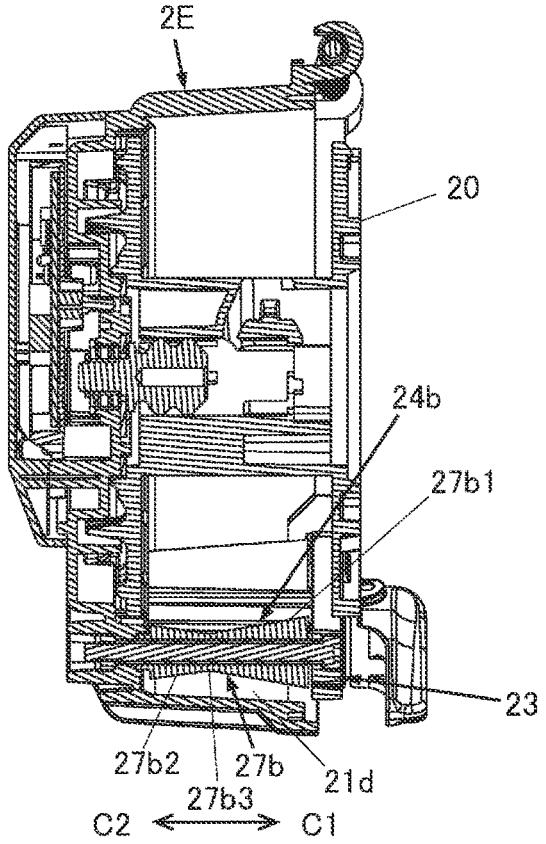
FIG. 10A is a cross-sectional view illustrating an example of a magazine according to a fourth embodiment.
Figure 10B:
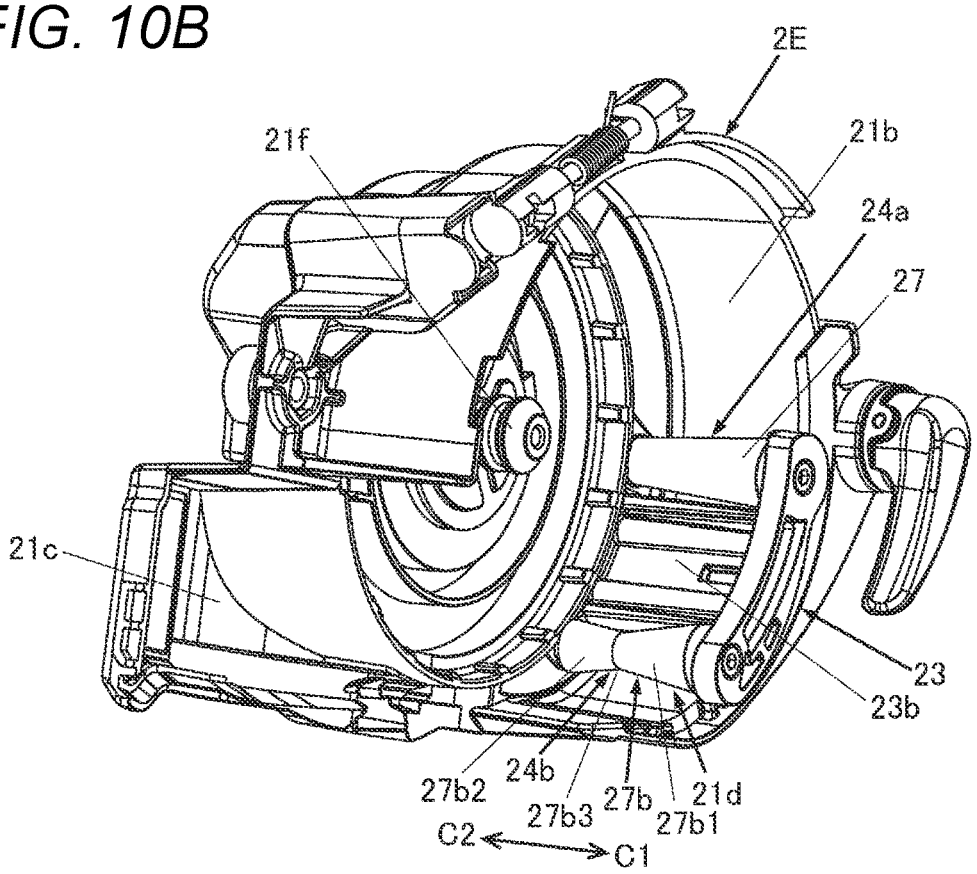
FIG. 10B is a perspective view illustrating the example of the magazine according to the fourth embodiment.

FIG. 10A is a cross-sectional view illustrating an example of a magazine according to a fourth embodiment, and FIG. 10B is a perspective view illustrating the example of the magazine according to the fourth embodiment. Further, a cross section in the cross-sectional view of FIG. 10A is equivalent to the line B5-B5 of FIG. 9A.

In a magazine 2E according to the fourth embodiment, configurations similar to those of the magazine 2A according to the first embodiment and the magazine 2D according to the third embodiment are denoted by the same reference numerals.

The magazine 2E includes a regulating portion 27*b* in the rotating member 24*b*. The magazine 2E may not include the protruding portion 23*b* and the rotating member 24*a* but include the rotating member 24*b* in the separating portion 23. In a configuration in which the rotating member 24*a* is provided, the regulating portion 27 described above may be provided in the rotating member 24*a*. The regulating portion 27*b* of the rotating member 24*b* includes a first regulating portion 27*b*1, a second regulating portion 27*b*2, and a bottom portion 27*b*3.

The first regulating portion 27*b*1 is constituted by an inclined surface where the outer peripheral surface of the rotating member 24*b* is inclined in a direction in which the diameter of the rotating member 24*b* decreases from the end portion of the rotating member 24*b* in the first direction indicated by the arrow C1 in which the reel 20 is offset, toward the bottom portion 27*b*3.

The second regulating portion 27*b*2 is constituted by an inclined surface where the outer peripheral surface of the rotating member 24*b* is inclined in a direction in which the diameter of the rotating member 24*b* decreases from the end portion of the rotating member 24*b* in the second direction indicated by the arrow C2 toward the bottom portion 27*b*3, and the second direction is opposite to the direction in which the reel 20 is offset.

The bottom portion 27*b*3 is constituted by providing, in the vicinity of a center in the axial direction of the rotating member 24*b*, a portion at which the diameter of the rotating member 24*b* becomes smallest between the first regulating portion 27*b*1 and the second regulating portion 27*b*2. The bottom portion 27*b*3 is provided at the center in the axial direction of the rotating member 24*b*, or a portion closer to the second direction than the center in the axial direction of the rotating member 24*b*, for example. In this example, the bottom portion 27*b*3 is formed of a V-shaped groove extending in the circumferential direction of the rotating member 24*b* by forming a cross-sectional shape along the axial direction of the rotating member 24*b* into a V-shape.

The regulating portion 27*b* has a conical shape inclined in a direction in which the wires W in contact with the rotating member 24*b* are led in the first direction indicated by the arrow C1 or the second direction indicated by the arrow C2 toward the bottom portion 27*b*3 in the vicinity of the center along the axial direction of the rotating member 24*b*.

Accordingly, when the wires W fed mainly in the forward direction come into contact with the regulating portion 27*b* of the rotating member 24*b*, the wires W are fed while being led toward the vicinity of the center along the axial direction of the rotating member 24*b* due to the conical shape of the regulating portion 27*b*. In addition, due to the conical shape of the regulating portion 27*b*, the movement of the wires W from the vicinity of the center along the axial direction of the rotating member 24*b* toward the first direction indicated by the arrow C1 or the second direction indicated by the arrow C2 is regulated.

Therefore, in the magazine 2E, the position of the wires W along the axial direction of the annular feeding path Ru and the axial direction of the reel 20 is stabilized without being biased in the first direction and the second direction. Accordingly, the wires W fed in the forward direction by the wire feeding portion 3A and curled by the curling guide 50*a* can be led to enter the leading guide 50*b*. Accordingly, even when a diameter of the reinforcing bars to be bound becomes large and the diameter of the annular feeding path of the wires becomes large, it is not necessary to increase a length of the leading guide 50*b* in a direction along the axial direction of the annular feeding path, it is possible to restrain the increase in size and the increase in weight of the reinforcing bar binding machine 1A, and it is possible to restrain the deterioration of operability.

Figure 11A:
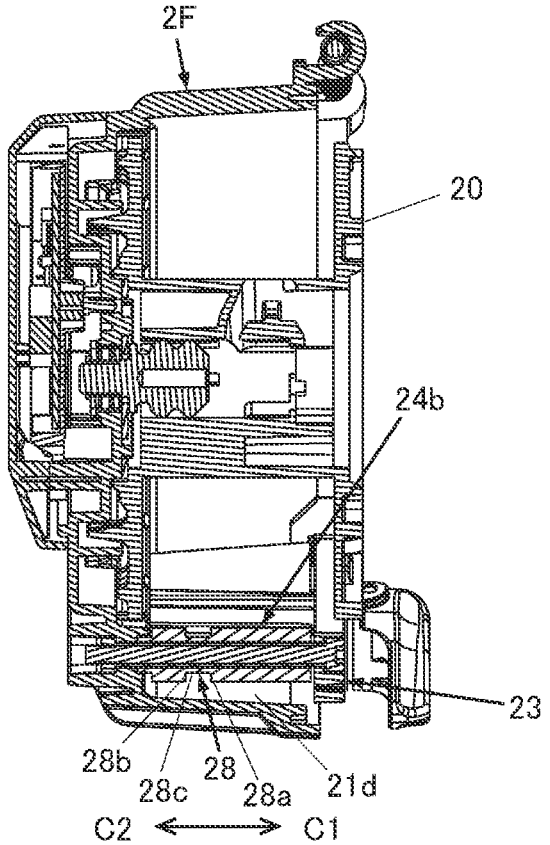
FIG. 11A is a cross-sectional view illustrating an example of a magazine according to a fifth embodiment.
Figure 11B:
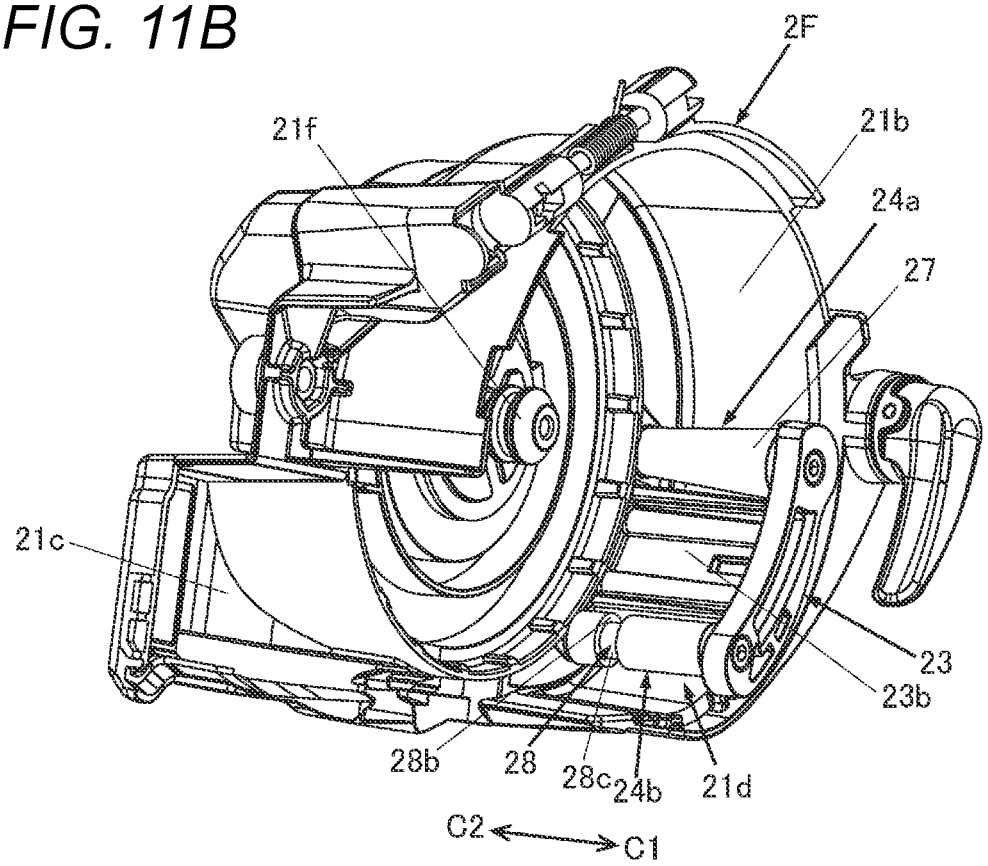
FIG. 11B is a perspective view illustrating the example of the magazine according to the fifth embodiment.

FIG. 11A is a cross-sectional view illustrating an example of a magazine according to a fifth embodiment, and FIG. 11B is a perspective view illustrating the example of the magazine according to the fifth embodiment. Further, a cross section in the cross-sectional view of FIG. 11A is equivalent to the line B5-B5 of FIG. 9A.

In a magazine 2F according to the fifth embodiment, configurations similar to those of the magazine 2A according to the first embodiment and the magazine 2D according to the third embodiment are denoted by the same reference numerals.

The magazine 2F includes a regulating portion 28 in the rotating member 24*b*. The magazine 2F may not include the protruding portion 23*b* and the rotating member 24*a* but include the rotating member 24*b* in the separating portion 23. In a configuration in which the rotating member 24*a* is provided, the regulating portion 27 described above may be provided in the rotating member 24*a*. The regulating portion 28 includes a first regulating portion 28*a* that regulates movement of the wires W in the first direction indicated by the arrow C1, a second regulating portion 28*b* that regulates movement of the wires W in the second direction indicated by the arrow C2, and a bottom portion 28*c* formed between the first regulating portion 28*a* and the second regulating portion 28*b*. The regulating portion 28 is constituted by providing a recess extending in the circumferential direction of the rotating member 24*b* on the outer peripheral surface in the vicinity of the center in the axial direction of the rotating member 24*b*. The first regulating portion 28*a* is provided in an end portion of the regulating portion 28 in the first direction in the form of being erected from the bottom portion 28*c*. The second regulating portion 28*b* is provided in an end portion of the regulating portion 28 in the second direction to face the first regulating portion 28*a* in the form of being erected from the bottom portion 28*c*. The bottom portion 28*c* is constituted by providing a portion at which the diameter of the rotating member 24*b* becomes smallest between the first regulating portion 28*a* and the second regulating portion 28*b*. In the regulating portion 28, a depth in the radial direction of the rotating member 24*b*, which is a depth from the outer peripheral surface of the rotating member 24*b* to the bottom portion 28*c*, is constituted by a length that allows the wires W to enter the regulating portion 28 and allows the wires W fed along the rotating member 24*b* to be held in the regulating portion 28. In addition, in the regulating portion 28, a width along the axial direction of the rotating member 24*b*, which is an interval between the first regulating portion 28*a* and the second regulating portion 28*b*, is constituted by a length that allows the wires W to enter the regulating portion 28 and allows the wires W to move by a predetermined amount along the axial direction of the rotating member 24*b* in the regulating portion 28. The regulating portion 28 is provided at the center in the axial direction of the rotating member 24*b*, or a portion closer to the second direction than the center in the axial direction of the rotating member 24*b*, for example.

The wires W enter the regulating portion 28 of the rotating member 24*b* by an operation of mainly feeding the wires W in the forward direction. In the configuration in which the rotating member 24*a* is further provided and the regulating portion 27 is provided in the rotating member 24*a*, when the wires W mainly fed in the forward direction come into contact with the regulating portion 27 of the rotating member 24*a*, due to the conical shape of the regulating portion 27, the wires W are fed while being led in the second direction indicated by the arrow C2. Accordingly, the movement of the wires W toward the first direction indicated by the arrow C1 in the feeding path forming portion 21*d* is regulated.

When the wires W are led in the second direction indicated by the arrow C2 by the regulating portion 27 of the rotating member 24*a*, the wires W are promoted to enter the regulating portion 28 of the rotating member 24*b*. The wires W having entered the regulating portion 28 of the rotating member 24*b* are fed while being accommodated in the regulating portion 28 due to an uneven shape of the outer peripheral surface of the rotating member 24*b*. Accordingly, the movement of the wires W from the vicinity of the center along the axial direction of the rotating member 24*b* toward the first direction indicated by the arrow C1 or the second direction indicated by the arrow C2 in the feeding path forming portion 21*d* is regulated by the first regulating portion 28*a* and the second regulating portion 28B.

Therefore, in the magazine 2F, the position of the wires W along the axial direction of the annular feeding path Ru and the axial direction of the reel 20 is stabilized without being biased in the first direction and the second direction. Accordingly, the wires W fed in the forward direction by the wire feeding portion 3A and curled by the curling guide 50*a* can be led to enter the leading guide 50*b*. Accordingly, even when a diameter of the reinforcing bars to be bound becomes large and the diameter of the annular feeding path of the wires becomes large, it is not necessary to increase a length of the leading guide 50*b* in a direction along the axial direction of the annular feeding path, it is possible to restrain the increase in size and the increase in weight of the reinforcing bar binding machine 1A, and it is possible to restrain the deterioration of operability.

Figure 12A:
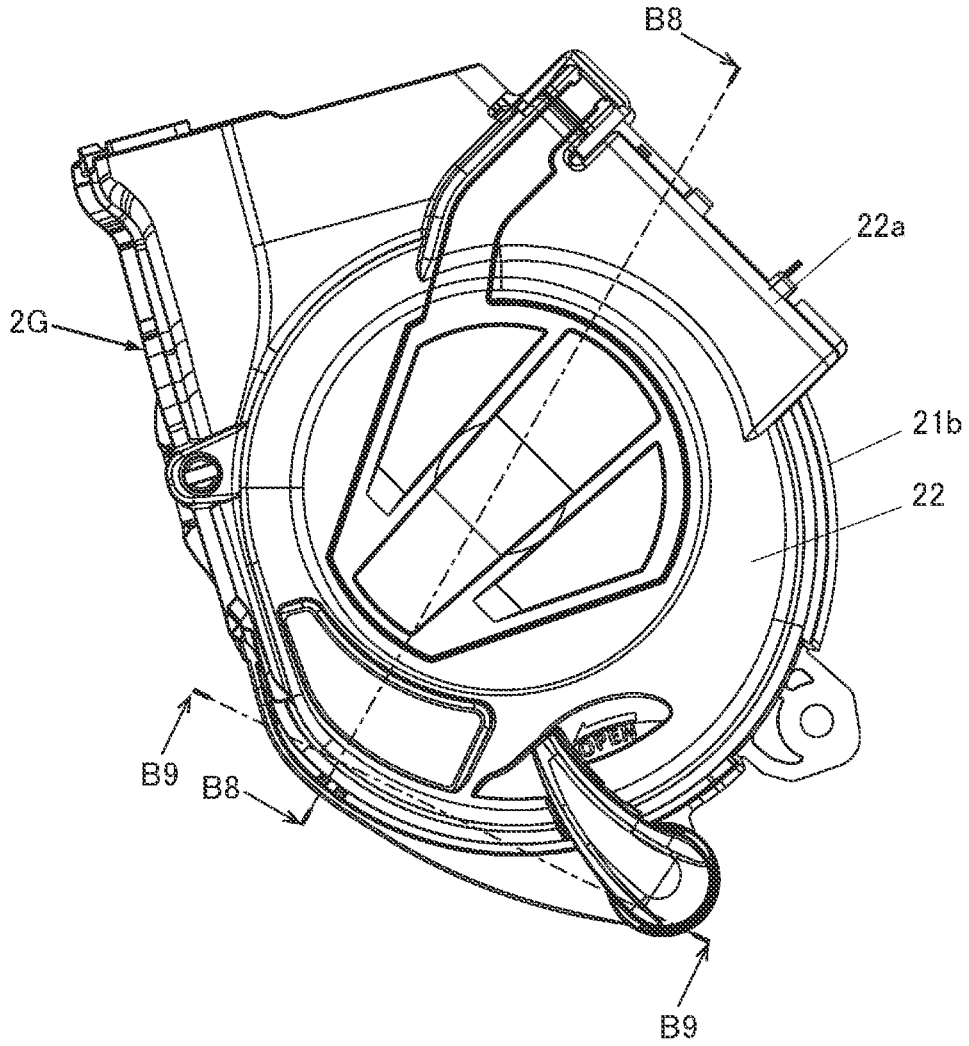
FIG. 12A is a side view illustrating an example of a magazine according to a sixth embodiment.
Figure 12B:
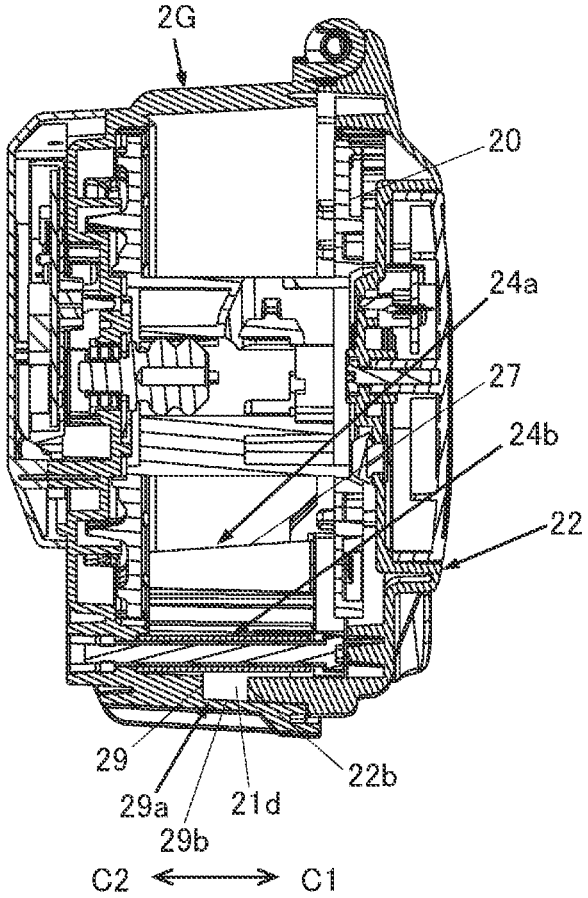
FIG. 12B is a cross-sectional view taken along a line B8-B8 of FIG. 12A.
Figure 12C:
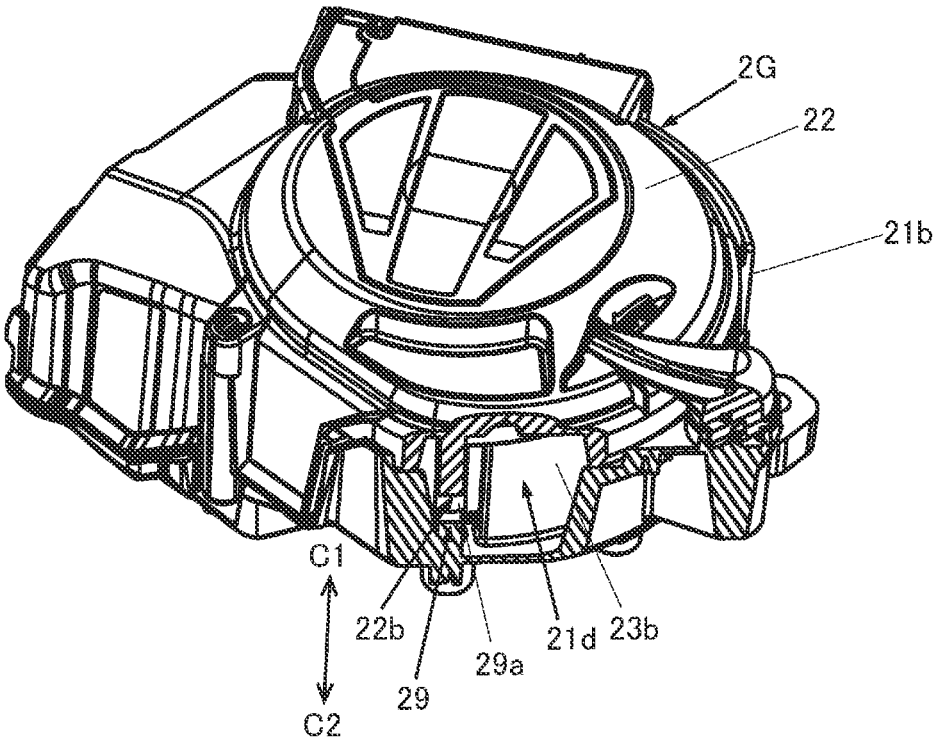
FIG. 12C is a cross-sectional perspective view taken along a line B9-B9 of FIG. 12A.
Figure 12D:
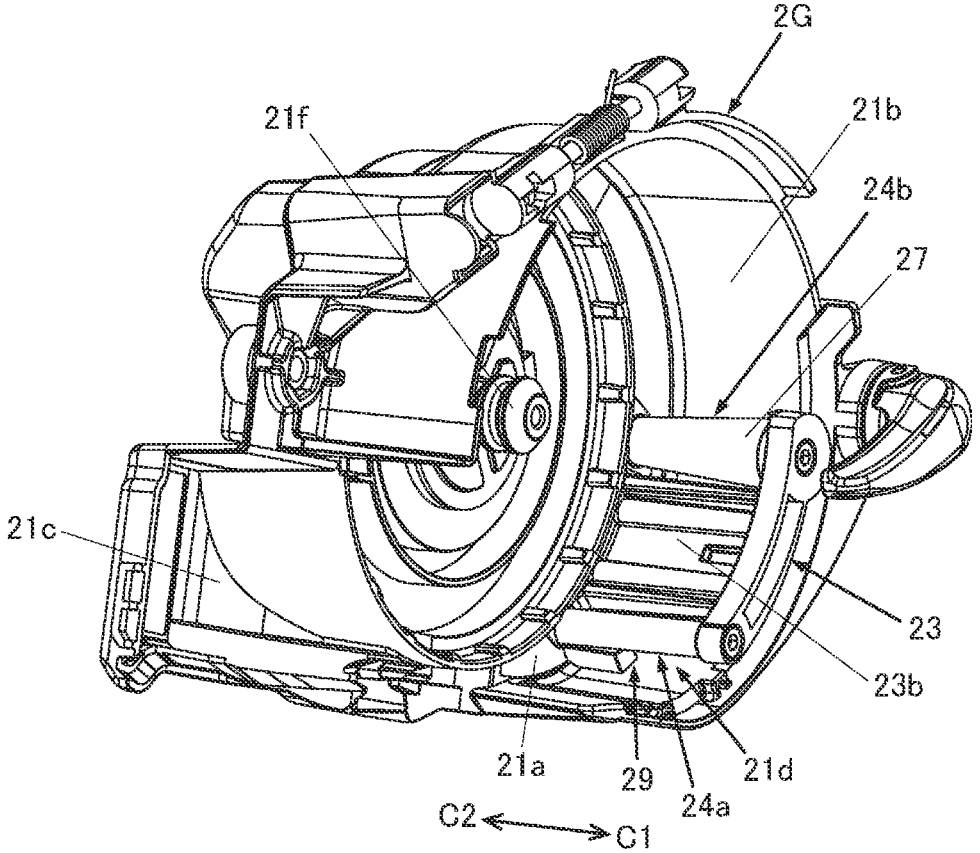
FIG. 12D is a perspective view illustrating the example of the magazine according to the sixth embodiment.

FIG. 12A is a side view illustrating an example of a magazine according to a sixth embodiment, FIG. 12B is a cross-sectional view taken along a line B8-B8 of FIG. 12A, FIG. 12C is a cross-sectional perspective view taken along a line B9-B9 of FIG. 12A, and FIG. 12D is a perspective view illustrating the example of the magazine according to the sixth embodiment.

In a magazine 2G according to the sixth embodiment, configurations similar to those of the magazine 2A according to the first embodiment and the magazine 2D according to the third embodiment are denoted by the same reference numerals. The magazine 2G includes a regulating portion 29*a* that regulates movement of the wires W in a direction, the direction intersects a direction in which the wires W are fed in the feeding path forming portion 21*d*, and is along the axial direction of the reel 20 and the axial direction of the annular feeding path Ru. The regulating portion 29*a* may include a second regulating portion 29 that regulates the movement of the wires W in the second direction indicated by the arrow C2 along the axial direction of the reel 20. The second regulating portion 29 is constituted by a protrusion that is provided on the downstream side in the feeding direction of the wires W fed in the forward direction with respect to the position at which the separating portion 23 is provided in the feeding path forming portion 21*d*, and protrudes in the first direction indicated by the arrow C1 from the side wall portion 21*a*.

The second regulating portion 29 is provided outside along the radial direction of the reel 20 with respect to the rotating member 24*b*. A protrusion height of the second regulating portion 29 from the side wall portion 21*a* is about less than half of the length of the rotating member 24*b* in the axial direction. The second regulating portion 29 faces the outer peripheral surface of the rotating member 24*b* at a predetermined interval. In order to restrain the wires W from moving in the second direction indicated by the arrow C2 and restrain the wires W from entering between the rotating member 24*b* and the second regulating portion 29, the second regulating portion 29 may face the outer peripheral surface of the rotating member 24*b* at an interval smaller than the diameter of the wires W.

The regulating portion 29*a* may include a first regulating portion 22*b* that regulates the movement of the wires W in the first direction indicated by the arrow C1 along the axial direction of the reel 20. The first regulating portion 22*b* is provided on the lid portion 22 constituting a side wall portion of the magazine 2G in the first direction. The first regulating portion 22*b* is constituted by a protrusion that is provided on the downstream side in the feeding direction of the wires W fed in the forward direction with respect to the position at which the separating portion 23 is provided in the feeding path forming portion 21*d*, and protrudes in the second direction indicated by the arrow C2 from the lid portion 22 when the magazine 2G is closed by the lid portion 22.

The first regulating portion 22*b* is provided outside along the radial direction of the reel 20 with respect to the rotating member 24*b*. A protrusion height of the first regulating portion 22*b* from the lid portion 22 is about less than half of the length of the rotating member 24*b* in the axial direction. The first regulating portion 22*b* faces the outer peripheral surface of the rotating member 24*b* at a predetermined interval. The first regulating portion 22*b* may face the outer peripheral surface of the rotating member 24*b* at an interval larger than the diameter of the wires W to an extent that the opening and closing of the lid portion 22 is not hindered, the wires W can be restrained from moving in the first direction indicated by the arrow C1, and the wires W can be restrained from entering between the rotating member 24*b* and the first regulating portion 22*b*.

Accordingly, in the regulating portion 29*a*, when the magazine 2G is closed by the lid portion 22, a bottom portion 29*b* is formed between the second regulating portion 29 and the first regulating portion 22*b*. The bottom portion 29*b* is constituted by providing a recess between the first regulating portion 22*b* and the second regulating portion 29 toward the outside along the radial direction of the reel 20. In the regulating portion 29*a*, a depth along the radial direction of the reel 20 is constituted by a length that allows the wires W to enter the regulating portion 29*a* and allows the wires W to be held in the regulating portion 29*a*. In addition, in the regulating portion 29*a*, a width along the axial direction of the rotating member 24*b* is constituted by a length that allows the wires W to enter the regulating portion 29*a* and allows the wires W to move by a predetermined amount along the axial direction of the rotating member 24*b* in the regulating portion 29*a*. The regulating portion 29*a* is provided to face the vicinity of the center along the axial direction of the rotating member 24*b*.

The wires W fed while being in contact with the outer peripheral surface of the rotating member 24*b* enter the regulating portion 29*a*. In the configuration in which the rotating member 24*a* is further provided and the regulating portion 27 is provided in the rotating member 24*a*, when the wires W mainly fed in the forward direction come into contact with the regulating portion 27 of the rotating member 24*a*, due to the conical shape of the regulating portion 27, the wires W are fed while being led in the second direction indicated by the arrow C2. Accordingly, the movement of the wires W toward the first direction indicated by the arrow C1 in the feeding path forming portion 21*d* is regulated.

Further, the wires W led in the second direction indicated by the arrow C2 by the regulating portion 27 of the rotating member 24*a* is promoted to enter the regulating portion 29*a*. The wires W having entered the regulating portion 29*a* are fed while being accommodated in the regulating portion 29*a*. Accordingly, the movement of the wires W from the vicinity of the center along the axial direction of the rotating member 24*b* toward the first direction indicated by the arrow C1 or the second direction indicated by the arrow C2 in the feeding path forming portion 21*d* is regulated.

Therefore, in the magazine 2G, the position of the wires W along the axial direction of the annular feeding path Ru and the axial direction of the reel 20 is stabilized without being biased in the first direction and the second direction. Accordingly, the wires W fed in the forward direction by the wire feeding portion 3A and curled by the curling guide 50*a* can be led to enter the leading guide 50*b*. Accordingly, even when a diameter of the reinforcing bars to be bound becomes large and the diameter of the annular feeding path of the wires becomes large, it is not necessary to increase a length of the leading guide 50*b* in a direction along the axial direction of the annular feeding path, it is possible to restrain the increase in size and the increase in weight of the reinforcing bar binding machine 1A, and it is possible to restrain the deterioration of operability.

Figure 13A:
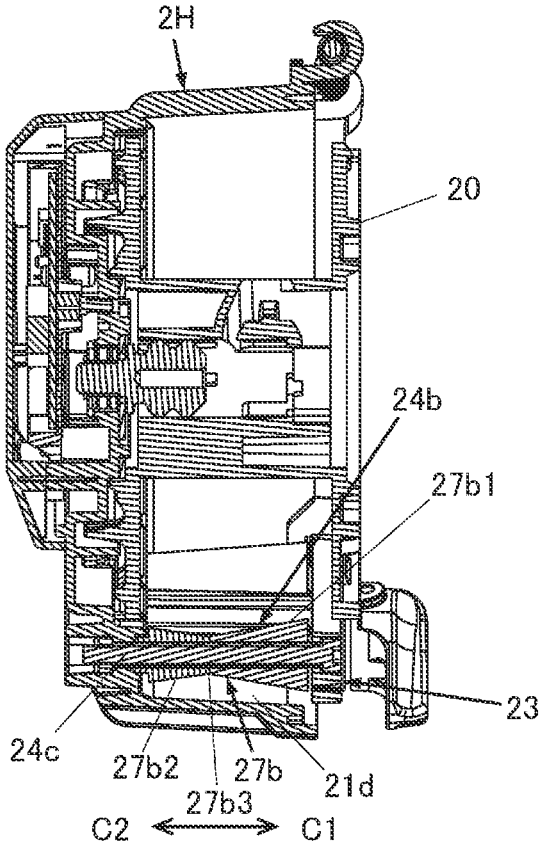
FIG. 13A is a cross-sectional view illustrating an example of a magazine according to a seventh embodiment.

FIG. 13A is a cross-sectional view illustrating an example of a magazine according to a seventh embodiment. Further, a cross section in the cross-sectional view of FIG. 13A is equivalent to the line B5-B5 of FIG. 9A.

In a magazine 2H according to the seventh embodiment, configurations similar to those of the magazine 2A according to the first embodiment and the magazine 2E according to the fourth embodiment are denoted by the same reference numerals.

The magazine 2H includes the regulating portion 27*b* in the rotating member 24*b*. The magazine 2H may not include the protruding portion 23*b* and the rotating member 24*a* but include the rotating member 24*b* in the separating portion 23. In a configuration in which the rotating member 24*a* is provided, the regulating portion 27 described above may be provided in the rotating member 24*a*. In a configuration in which the regulating portion 27*b* of the rotating member 24*b* is divided into at least two portions in the axial direction, the regulating portion 27*b* includes the first regulating portion 27*b*1 and the second regulating portion 27*b*2.

The first regulating portion 27*b*1 is constituted by a conical member that has the inclined surface where the outer peripheral surface of the rotating member 24*b* is inclined in the direction in which the diameter of the rotating member 24*b* decreases from the end portion of the rotating member 24*b* in the first direction indicated by the arrow C1 in which the reel 20 is offset, toward the second direction indicated by the arrow C2, and the second direction is opposite to the first direction in which the reel 20 is offset.

The second regulating portion 27*b*2 is constituted by a conical member that has an inclined surface where the outer peripheral surface of the rotating member 24*b* is inclined in a direction in which the diameter of the rotating member 24*b* decreases from the end portion of the rotating member 24*b* in the second direction indicated by the arrow C2 toward the first direction indicated by the arrow C1.

In the rotating member 24*b*, the first regulating portion 27*b*1 and the second regulating portion 27*b*2 are rotatably attached to a shaft 24*c*. In the rotating member 24*b*, when the first regulating portion 27*b*1 and the second regulating portion 27*b*2 are attached to the shaft 24*c*, the bottom portion 27*b*3 is formed between the first regulating portion 27*b*1 and the second regulating portion 27*b*2.

The bottom portion 27*b*3 is constituted by providing, in the vicinity of the center in the axial direction of the rotating member 24*b*, the portion at which the diameter of the rotating member 24*b* becomes smallest.

Figure 13B:
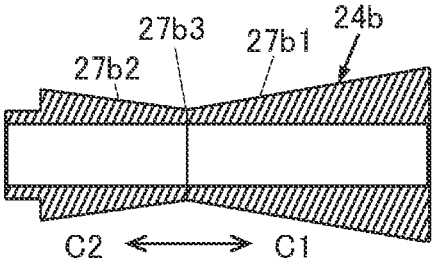
FIG. 13B is a cross-sectional view illustrating an example of the rotating member.
Figure 13C:
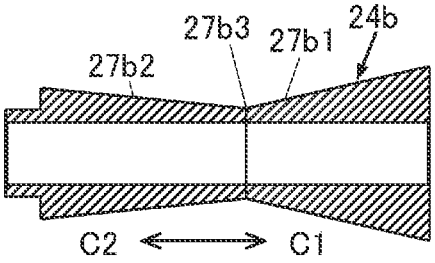
FIG. 13C is a cross-sectional view illustrating an example of the rotating member.
Figure 13D:
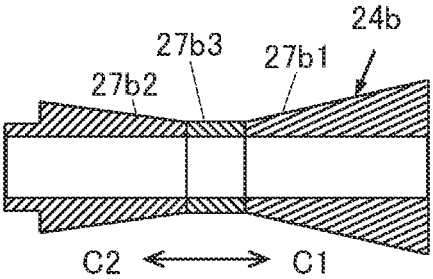
FIG. 13D is a cross-sectional view illustrating an example of the rotating member.

FIGS. 13B, 13C and 13D are cross-sectional views illustrating an example of the rotating member 24*b*. Regarding the rotating member 24*b*, combinations of a plurality of types of first regulating portions 27*b*1 and second regulating portions 27*b*2 having different lengths in the axial direction, different inclined angles of the inclined surface, and the like are prepared. Accordingly, by combining the first regulating portion 27*b*1 and the second regulating portion 27*b*2, the rotating member 24*b* can be implemented in a desired form such as a form in which the bottom portion 27*b*3 is provided at a portion closer to the first direction than the center in the axial direction of the rotating member 24*b*, a form in which the bottom portion 27*b*3 is provided at a portion closer to the second direction than the center in the axial direction of the rotating member 24*b*, as illustrated in FIGS. 13B and 13C, or a form in which the bottom portion 27*b*3 is provided at the center in the axial direction of the rotating member 24*b* as illustrated in FIG. 13D.

Further, the rotating member 24*b* may adopt a configuration combining three or more divided parts, and for example, as illustrated in FIG. 13C, the bottom portion 27*b*3 may be a part independent of the first regulating portion 27*b*1 and the second regulating portion 27*b*2.

Therefore, in the magazine 2H, the position of the wires W along the axial direction of the annular feeding path Ru and the axial direction of the reel 20 can be stabilized at a desired position without being biased in the first direction and the second direction.

Figure 14A:
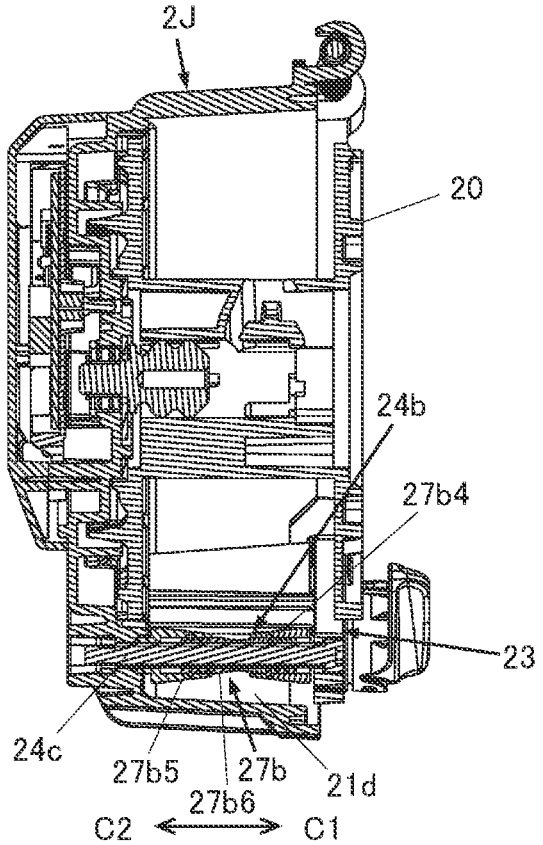
FIG. 14A is a cross-sectional view illustrating an example of a magazine according to an eighth embodiment.
Figure 14B:
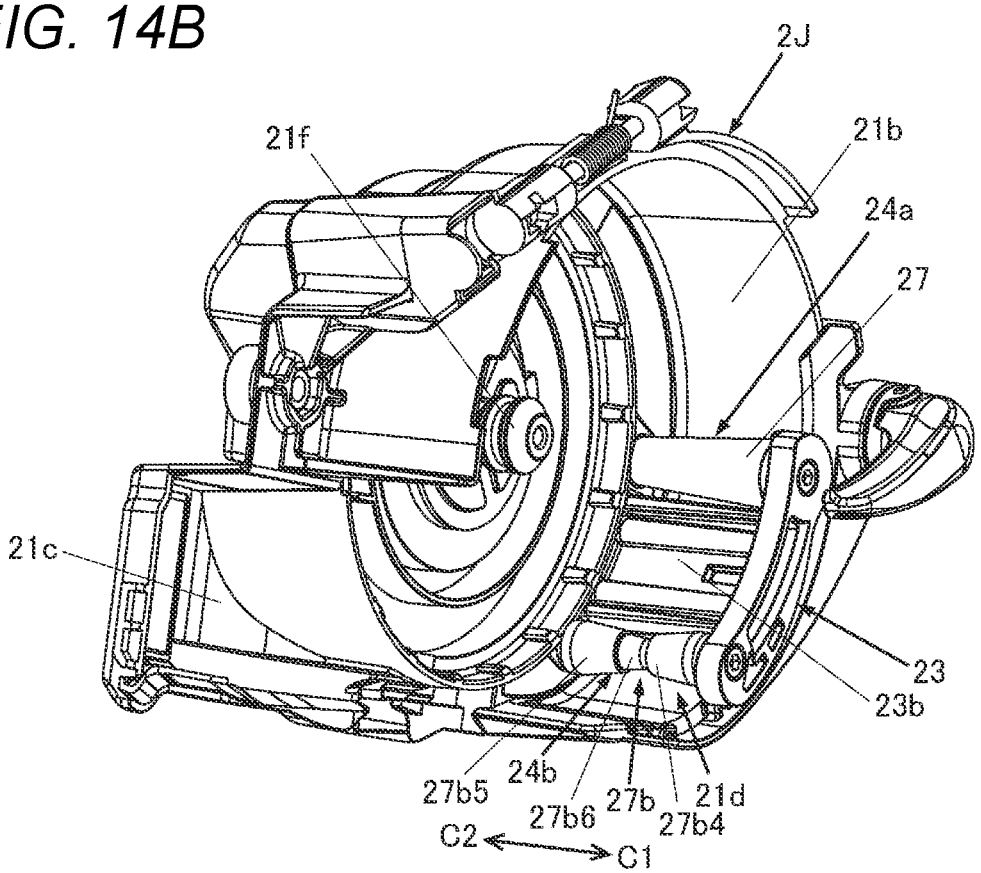
FIG. 14B is a perspective view illustrating the example of the magazine according to the eighth embodiment.
Figure 14C:
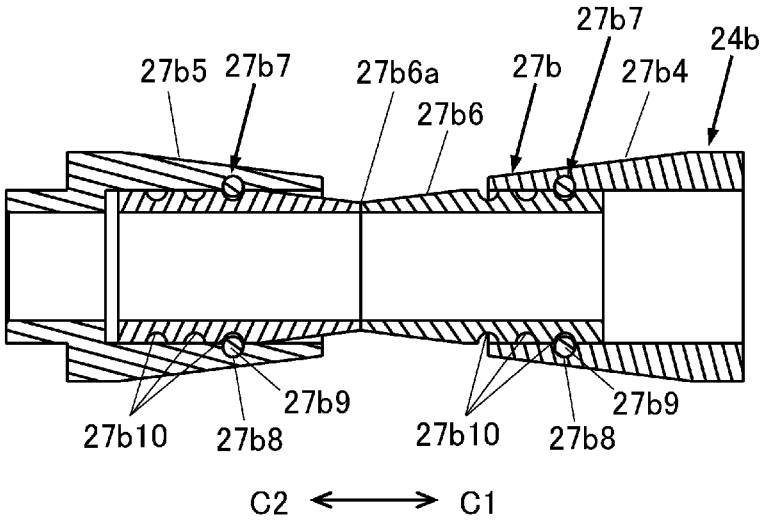
FIG. 14C is a cross-sectional view illustrating an example of an adjusting portion.
Figure 14D:
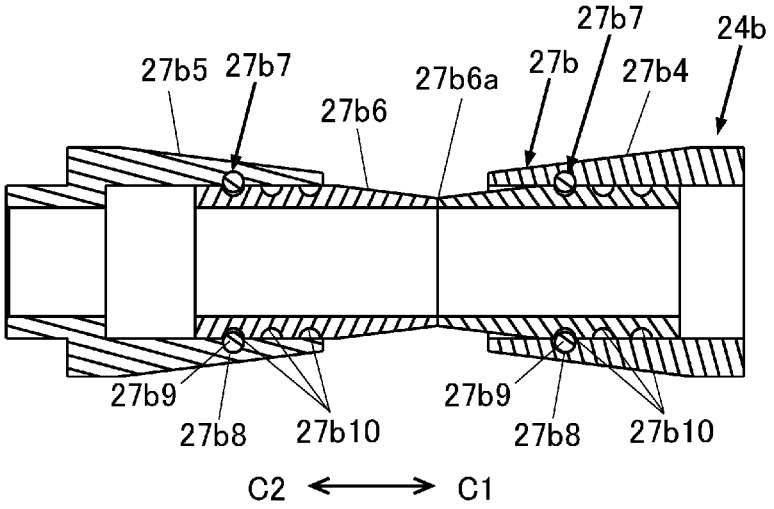
FIG. 14D is a cross-sectional view illustrating the example of the adjusting portion.

FIG. 14A is a cross-sectional view illustrating an example of a magazine according to an eighth embodiment, and FIG. 14B is a perspective view illustrating the example of the magazine according to the eighth embodiment. Further, a cross section in the cross-sectional view of FIG. 14A is equivalent to the line B5-B5 of FIG. 9A. FIGS. 14C and 14D are cross-sectional views illustrating an example of an adjusting portion.

In a magazine 2J according to the eighth embodiment, configurations similar to those of the magazine 2A according to the first embodiment and the magazine 2E according to the fourth embodiment are denoted by the same reference numerals.

The magazine 2J includes the regulating portion 27*b* in the rotating member 24*b*. The magazine 2J may not include the protruding portion 23*b* and the rotating member 24*a* but include the rotating member 24*b* in the separating portion 23. In a configuration in which the rotating member 24*a* is provided, the regulating portion 27 described above may be provided in the rotating member 24*a*. The regulating portion 27*b* of the rotating member 24*b* includes a first regulating portion 27*b*4, a second regulating portion 27*b*5, and an adjusting portion 27*b*6.

The first regulating portion 27*b*4 is constituted by a conical member that has an inclined surface where the outer peripheral surface of the rotating member 24*b* is inclined in a direction in which the diameter of the rotating member 24*b* decreases from an end portion side of the rotating member 24*b* in the first direction indicated by the arrow C1 in which the reel 20 is offset, toward the adjusting portion 27*b*6.

The second regulating portion 27*b*5 is constituted by a conical member that has an inclined surface where the outer peripheral surface of the rotating member 24*b* is inclined in a direction in which the diameter of the rotating member 24*b* decreases from an end portion side of the rotating member 24*b* in the second direction indicated by the arrow C2 toward the adjusting portion 27*b*6, and the second direction is opposite to the direction in which the reel 20 is offset.

The adjusting portion 27*b*6 is constituted in a form of connecting the conical member having the inclined surface where the outer peripheral surface is inclined in the direction in which the diameter decreases from the end portion side in the first direction indicated by the arrow C1 toward the center in the axial direction, and the conical member having the inclined surface where the outer peripheral surface is inclined in the direction in which the diameter decreases from the end portion side in the second direction indicated by the arrow C2 toward the center in the axial direction. A diameter of the adjusting portion 27*b*6 becomes smallest in the vicinity of the center along the axial direction, and a bottom portion 27*b*6*a* is formed at a portion where the diameter becomes smallest. In this example, the bottom portion 27*b*6*a* is formed of a V-shaped groove extending in a circumferential direction of the adjusting portion 27*b*6 by forming a cross-sectional shape along an axial direction of the adjusting portion 27*b*6 into a V-shape.

In the rotating member 24*b*, the first regulating portion 27*b*4, the second regulating portion 27*b*5, and the adjusting portion 27*b*6 are rotatably attached to the shaft 24*c*. Further, the adjusting portion 27*b*6 is movable in the axial direction with respect to the first regulating portion 27*b*4 and the second regulating portion 27*b*5. The rotating member 24*b* includes positioning portions 27*b*7 that determine a position of the adjusting portion 27*b*6 in the axial direction in an adjustable manner with respect to the first regulating portion 27*b*4 and the second regulating portion 27*b*5.

Each positioning portion 27*b*7 includes, on a corresponding inner peripheral surface of the first regulating portion 27*b*4 and the second regulating portion 27*b*5, a groove portion 27*b*8 along a circumferential direction. Further, the positioning portion 27*b*7 includes an elastic member 27*b*9 fitted in the groove portion 27*b*8. The elastic member 27*b*9 is constituted by an elastically deformable member such as an O-ring. Further, the positioning portion 27*b*7 includes, on an outer peripheral surface of the adjusting portion 27*b*6, groove portions 27*b*10 along the circumferential direction. The groove portions 27*b*10 have a shape capable of being engaged with and disengaged from the elastic members 27B9, and are formed at a plurality of positions along the axial direction of the adjusting portion 27*b*6.

When the adjusting portion 27*b*6 is inserted into the inner peripheral surfaces of the first regulating portion 27*b*4 and the second regulating portion 27*b*5, the elastic members 27B9 are freely fitted into the groove portions 27*b*10 of the adjusting portion 27*b*6, whereby the position of the adjusting portion 27*b*6 in the axial direction with respect to the first regulating portion 27*b*4 and the second regulating portion 27*b*5 is determined. Further, when the adjusting portion 27*b*6 is moved in the axial direction with respect to the first regulating portion 27*b*4 and the second regulating portion 27*b*5, the elastic members 27*b*9 are elastically deformed, and thus the groove portions 27*b*10 into which the elastic members 27*b*9 are fitted are changed, and the position of the adjusting portion 27*b*6 in the axial direction with respect to the first regulating portion 27*b*4 and the second regulating portion 27*b*5 is determined according to the provided positions of the groove portions 27*b*10.

Accordingly, the rotating member 24*b* can be implemented in a desired form such as a form in which the bottom portion 27*b*6*a* is provided at a portion closer to the first direction than the center in the axial direction of the rotating member 24*b*, a form in which the bottom portion 27*b*6*a* is provided at a portion closer to the second direction than the center in the axial direction of the rotating member 24*b*, as illustrated in FIGS. 14C and 14D, or a form in which the bottom portion 27*b*6*a* is provided at the center in the axial direction of the rotating member 24*b* although not shown. Therefore, in the magazine 2J, the position of the wires W along the axial direction of the annular feeding path Ru and the axial direction of the reel 20 can be adjusted in a stepwise manner, and the position of the wires W in the same direction can be stabilized at a desired position without being biased in the first direction and the second direction.

Figure 15A:
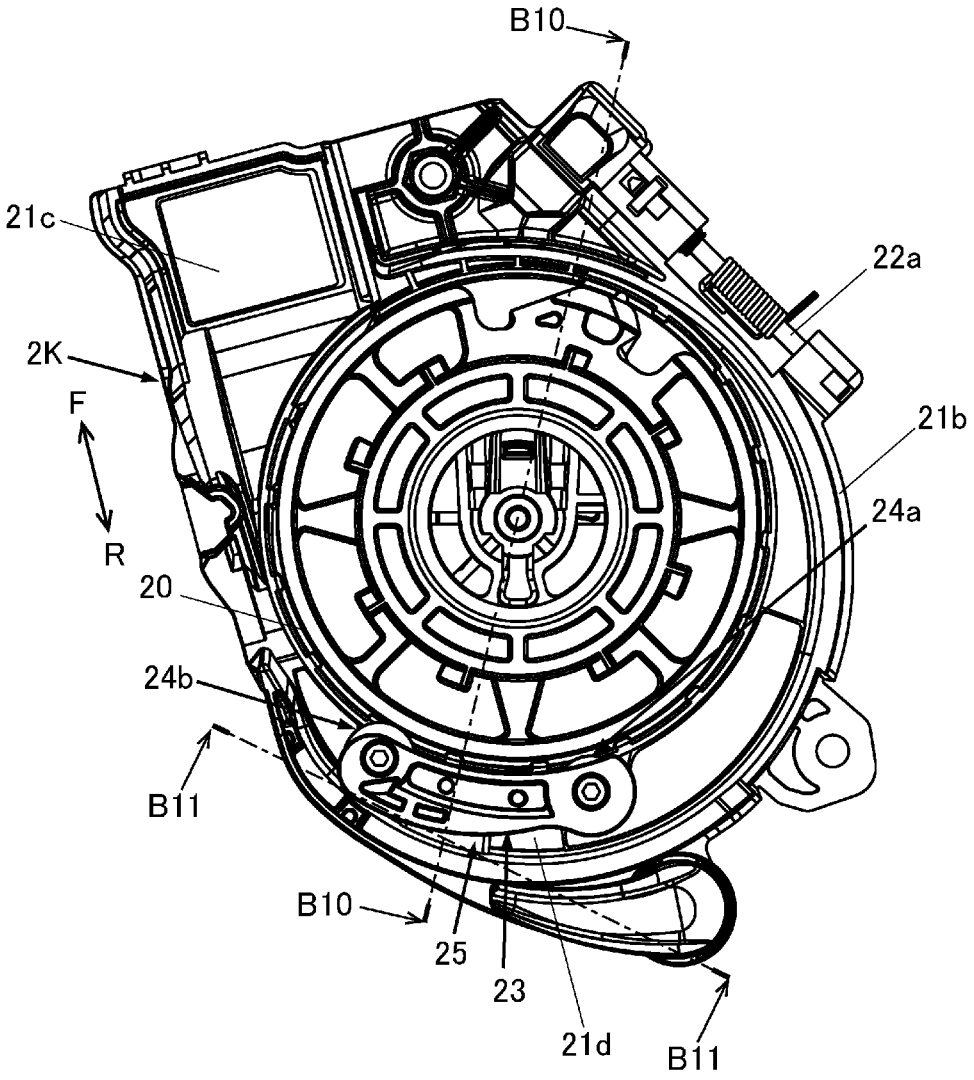
FIG. 15A is a side view illustrating an example of a magazine according to a ninth embodiment.
Figure 15B:
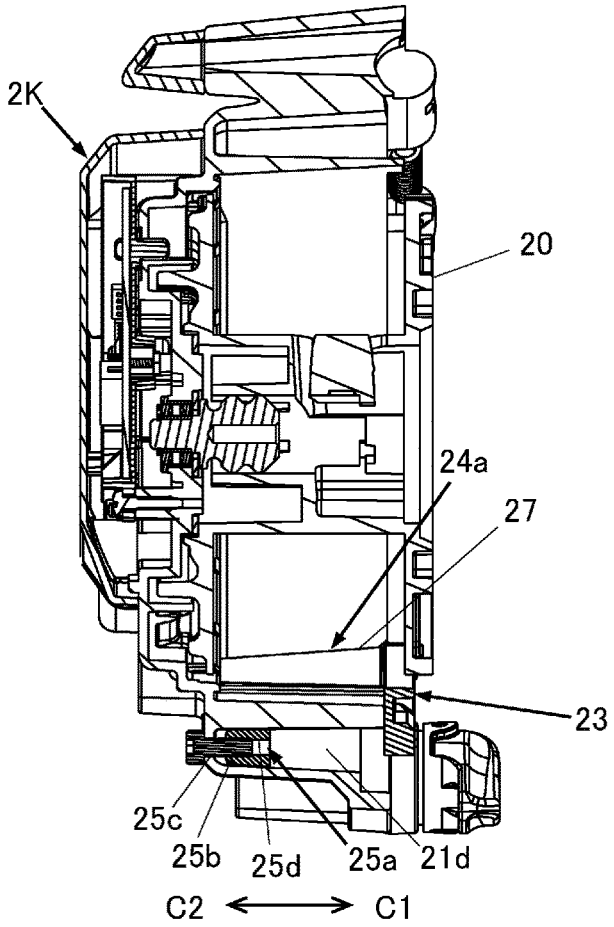
FIG. 15B is a cross-sectional view taken along a line B10-B10 of FIG. 15A.
Figure 15C:
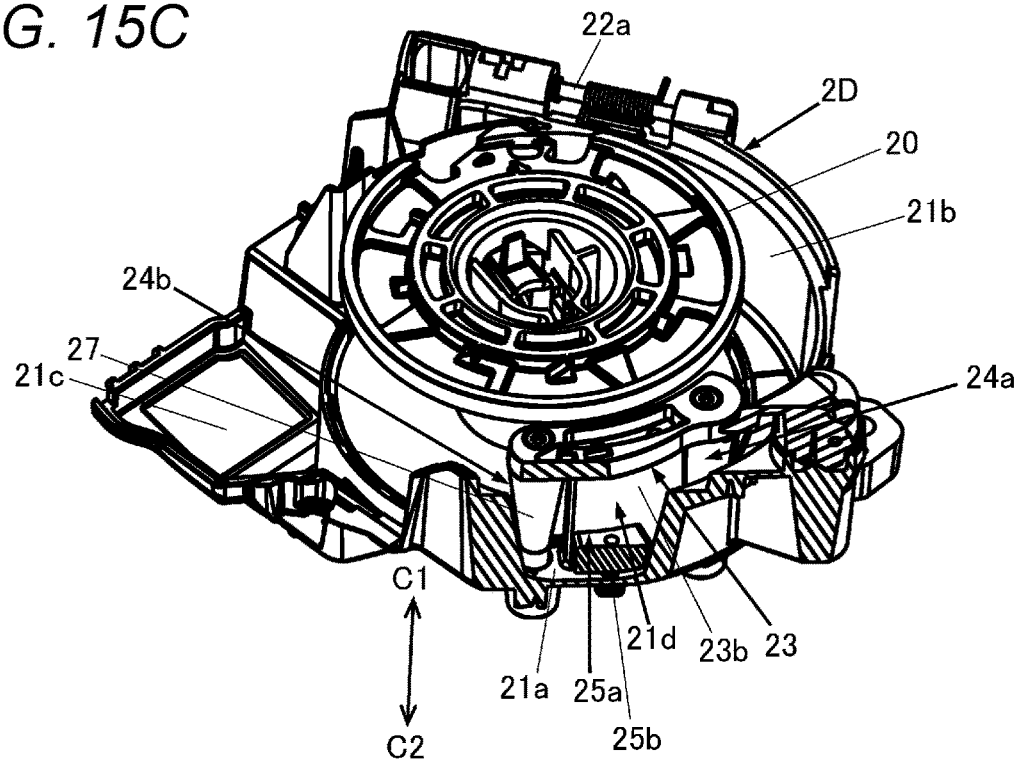
FIG. 15C is a cross-sectional perspective view taken along a line B11-B11 of FIG. 15A.

FIG. 15A is a side view illustrating an example of a magazine according to a ninth embodiment, FIG. 15B is a cross-sectional view taken along a line B10-B10 of FIG. 15A, and FIG. 15C is a cross-sectional perspective view taken along a line B11-B11 of FIG. 15A.

In a magazine 2K according to the ninth embodiment, configurations similar to those of the magazine 2A according to the first embodiment and the magazine 2D according to the third embodiment are denoted by the same reference numerals. The magazine 2K includes the separating portion 23 in the feeding path forming portion 21*d*. The separating portion 23 separates the reel 20 accommodated in the magazine 2K and the wires W bent by the feeding path forming portion 21*d*.

The magazine 2K includes the rotating member 24*b* on the downstream side in the feeding direction of the wires W indicated by the arrow F with respect to the protruding portion 23*b* of the separating portion 23. In addition, the magazine 2K includes the regulating portion 27 in the rotating member 24*b*. The magazine 2K may include the rotating member 24*a* on the upstream side in the feeding direction of the wires W indicated by the arrow F with respect to the protruding portion 23*b* of the separating portion 23, and may include the regulating portion 27 in the rotating member 24*a*.

The magazine 2K includes a regulating member 25*a* that regulates the movement of the wires W in the second direction indicated by the arrow C2 along the axial direction of the reel 20, and an adjusting member 25*b* that determines a position of the regulating member 25*a* in an adjustable manner.

The regulating member 25*a* is provided on the upstream side in the feeding direction of the wires W indicated by the arrow F with respect to the rotating member 24*b*. The regulating member 25*a* may be provided on the downstream side in the feeding direction of the wires W indicated by the arrow F with respect to the rotating member 24*b*. In addition, the regulating member 25*a* may be provided on the upstream side and the downstream side in the feeding direction of the wires W indicated by the arrow F with respect to the rotating member 24*b*. In a configuration in which the rotating member 24*b* and further the rotating member 24*a* are provided, the regulating member 25*a* is provided outside along the radial direction of the reel 20 with respect to the separating portion 23 between the rotating member 24*a* and the rotating member 24*b*. The regulating member 25*a* is supported by the adjusting member 25*b* in a form of protruding in the first direction indicated by the arrow C1 from a side wall portion 21*a* side.

The adjusting member 25*b* is constituted by a screw and is rotatably inserted into a hole 25*c* formed in the side wall portion 21*a*. The adjusting member 25*b* inserted into the hole 25*c* extends in the first direction indicated by the arrow C1 and the second direction indicated by the arrow C2 along the axial direction of the reel 20. The adjusting member 25*b* is screwed into a female screw hole 25*d* formed in the regulating member 25*a*. Accordingly, when the adjusting member 25*b* is rotated, the regulating member 25*a* moves in the first direction indicated by the arrow C1 and the second direction indicated by the arrow C2, and a protrusion height of the regulating member 25*a* from the side wall portion 21*a* is freely switched. The adjusting member 25*b* may include a sliding-off prevention structure for fixing the position of the regulating member 25*a* in an adjustable manner, for example, by increasing friction between a male screw and a female screw.

When the wires W mainly fed in the forward direction come into contact with the regulating portion 27 of the rotating member 24*a* and/or the rotating member 24*b*, the wires W are fed while being led in the second direction indicated by the arrow C2 due to the conical shape of the regulating portion 27, and the wires W are regulated from moving in the first direction indicated by the arrow C1 in the feeding path forming portion 21*d*.

On the other hand, since the regulating member 25*a* is provided in a form of protruding in the first direction indicated by the arrow C1 from the side wall portion 21*a*, the wires W passing through the outside of the separating portion 23 are restrained from moving in the second direction beyond the regulating member 25*a*. Accordingly, the wires W drawn out from the reel 20 are restrained from being located close to the second direction inside the magazine 2K. Further, when the adjusting member 25*b* is rotated, the protrusion height of the regulating member 25*a* from the side wall portion 21*a* is freely switched. Therefore, in the magazine 2K, the position of the wires W along the axial direction of the annular feeding path Ru and the axial direction of the reel 20 can be freely adjusted, and the position of the wires W in the same direction can be stabilized at a desired position without being biased in the first direction and the second direction.

As described above, in the configuration in which the position of the wires W along the axial direction of the annular feeding path Ru and the axial direction of the reel 20 can be adjusted, the position of the wires W in the same direction can be adjusted according to the size of the diameter of the annular feeding path of the wires such that the wires W fed in the forward direction by the wire feeding portion 3A and curled by the curling guide 50*a* enter the leading guide 50*b*.

Also in the third embodiment to the ninth embodiment described above, a configuration in which the reinforcing bars S are bound by a plurality of wires W may be adopted, a configuration in which the reinforcing bars S are bound by a single wire W may be adopted, and the number of wires W is not essential.

What is claimed is:

1. A binding machine, comprising:

a magazine configured to accommodate a wire;

a wire feeding portion configured to feed a wire accommodated in the magazine;

a curl forming portion configured to constitute an annular feeding path for winding the wire fed by the wire feeding portion around a binding object; and a binding portion configured to twist the wire wound around the binding object, wherein the curl forming portion includes a curling guide that curls the wire fed by the wire feeding portion, and a leading guide that leads the wire curled by the curling guide to the binding portion, and the magazine includes a shaft portion extending in a first direction and configured to support a reel around which the wire is wound, a feeding path forming portion that forms a feeding path of the wire, a separating portion disposed in the feeding path and configured to separate the wire, which is bent by the feeding path forming portion, from the reel, and a regulating portion disposed between the separating portion and a peripheral wall portion of the magazine and comprising a protrusion protruding in the first direction, wherein the first direction intersects a direction in which the wire is fed in the feeding path forming portion, and the regulating portion regulates movement of the wire in the first direction.

2. The binding machine according to claim 1, wherein the magazine includes a feeding port for the wire on a first side of the magazine where the magazine is connected to the wire feeding portion, and the feeding path forming portion is arranged on a second side of the magazine opposite to the feeding port with respect to an accommodation position of the reel, the accommodation position being interposed between the first side and the second side.

3. The binding machine according to claim 2, wherein the magazine is disposed so as to be offset in the first direction with respect to the curling guide, and the regulating portion regulates movement of the wire in a second direction opposite to the first direction.

4. The binding machine according to claim 3, wherein the protrusion protrudes in the first direction from a side wall portion of the magazine.

5. The binding machine according to claim 3, wherein the magazine includes, in the feeding path forming portion, a rotating member that has a rotation axis extending in the first direction, and the regulating portion includes an inclined surface where an outer peripheral surface of the rotating member is inclined so that a diameter of the rotating member is reduced from an end portion of the rotating member in the second direction opposite the first direction.

6. The binding machine according to claim 2, wherein the magazine is disposed so as to be offset in the first direction with respect to the curling guide, and the regulating portion regulates movement of the wire in the first direction.

7. The binding machine according to claim 6, wherein the magazine includes, in the feeding path forming portion, a rotating member that has a rotation axis extending in the first direction, and the regulating portion includes an inclined surface where an outer peripheral surface of the rotating member is inclined so that a diameter of the rotating member is reduced from an end portion of the rotating member in the first direction.

8. The binding machine according to claim 3, wherein the protrusion protrudes in the first direction from a side wall portion of the magazine.

9. The binding machine according to claim 2, wherein the magazine is disposed so as to be offset in the first direction with respect to the curling guide, the regulating portion includes a first regulating portion that regulates movement of the wire in the first direction, a second regulating portion that regulates movement of the wire in a second direction opposite to the first direction, and a bottom portion formed between the first regulating portion and the second regulating portion.

10. The binding machine according to claim 9, wherein the regulating portion further includes a rotating member arranged in the feeding path forming portion and the rotating member comprises a rotation axis extending in the first direction, the first regulating portion, the second regulating portion, and the bottom portion, the first regulating portion includes an inclined surface where an outer peripheral surface of the rotating member decreases in diameter from an end portion of the rotating member in the first direction, the second regulating portion includes an inclined surface where the outer peripheral surface of the rotating member decreases in diameter from an end portion of the rotating member in the second direction, and the bottom portion includes a portion at which the diameter of the rotating member is smallest and is arranged between the first regulating portion and the second regulating portion.

11. The binding machine according to claim 9, wherein the regulating portion further includes a rotating member arranged in the feeding path forming portion and the rotating member comprises a rotation axis extending in the first direction, the first regulating portion, the second regulating portion, and the bottom portion, the regulating portion includes, on an outer peripheral surface of the rotating member, a recess extending in a circumferential direction of the rotating member, the first regulating portion is provided in an end portion of the regulating portion and extends in the first direction, the second regulating portion is provided in another end portion of the regulating portion and extends in the second direction so as to face the first regulating portion, and the bottom portion includes a portion at which a diameter of the rotating member is smallest and is arranged between the first regulating portion and the second regulating portion.

12. The binding machine according to claim 9, wherein the first regulating portion includes a first protrusion protruding in the second direction with respect to side wall portion of the magazine, the second regulating portion includes a second protrusion protruding in the first direction with respect to another side wall portion of the magazine, and the bottom portion includes a recess between the first regulating portion and the second regulating portion which is open toward the peripheral wall portion.

13. The binding machine according to claim 10, wherein a position of the bottom portion along the rotation axis of the rotating member is adjustable.

14. The binding machine according to claim 2, wherein the magazine is disposed so as to be offset in the first direction with respect to the curling guide, and a position of the regulating portion is adjustable along the first direction and a second direction opposite to the first direction.

15. The binding machine according to claim 5, wherein the rotating member is a plurality of rotating members arranged along the feeding path, and at least one of the rotating members includes the regulating portion.

16. The binding machine according to claim 3, wherein the magazine includes, in the feeding path forming portion, a rotating member that has a rotation axis extending in the first direction, and the regulating portion includes an outer peripheral surface that is inclined so that a first diameter of a first end portion of the rotating member is smaller than a second diameter of a second end portion of the rotating member.

17. The binding machine according to claim 11, wherein a position of the bottom portion along the rotation axis of the rotating member is adjustable.

18. The binding machine according to claim 7, wherein the rotating member is a plurality of rotating members arranged along the feeding path, and at least one of the rotating members includes the regulating portion.

19. The binding machine according to claim 10, wherein the rotating member is a plurality of rotating members arranged along the feeding path, and at least one of the rotating members includes the regulating portion.

20. The binding machine according to claim 11, wherein the rotating member is a plurality of rotating members arranged along the feeding path, and at least one of the rotating members includes the regulating portion.

* * * * *